US012263554B2

(12) United States Patent
Ng

(10) Patent No.: US 12,263,554 B2
(45) Date of Patent: Apr. 1, 2025

(54) BLADE SHARPENING ASSEMBLY

(71) Applicant: Choon's Kitchenware, LLC, Farmington Hills, MI (US)

(72) Inventor: Cheong Choon Ng, Novi, MI (US)

(73) Assignee: Choon's Kitchenware, LLC, Farmington Hills, MI (US)

( * ) Notice: Subject to any disclaimer, the term of this patent is extended or adjusted under 35 U.S.C. 154(b) by 344 days.

(21) Appl. No.: 17/689,086

(22) Filed: Mar. 8, 2022

(65) Prior Publication Data

US 2022/0314388 A1 Oct. 6, 2022

Related U.S. Application Data

(63) Continuation-in-part of application No. 17/217,134, filed on Mar. 30, 2021, now abandoned.

(51) Int. Cl.
*B24B 3/54* (2006.01)

(52) U.S. Cl.
CPC ..... *B24B 3/54* (2013.01)

(58) Field of Classification Search
CPC .... B24D 15/06; B24D 15/063; B24D 15/065; B24D 15/08; B24B 3/36; B24B 3/38; B24B 3/52; B24B 3/54; B24B 3/546
See application file for complete search history.

(56) References Cited

U.S. PATENT DOCUMENTS

| | | | | | |
|---|---|---|---|---|---|
| 1,213,339 | A * | 1/1917 | D'Amato | B24D 15/08 | 451/367 |
| 2,131,626 | A * | 9/1938 | Keith | B24D 15/06 | 451/380 |
| 2,370,908 | A * | 3/1945 | Llorens | B24D 15/06 | 451/367 |
| 2,644,279 | A * | 7/1953 | Stankovich | B24B 41/066 | 451/380 |
| 5,944,592 | A * | 8/1999 | Hall | B24B 19/16 | 451/321 |
| 6,030,281 | A * | 2/2000 | Cozzini | B24B 41/06 | 451/320 |
| 7,104,876 | B1 * | 9/2006 | Lin | B24D 15/06 | 451/367 |
| 2009/0088053 | A1 * | 4/2009 | Hummel | B24B 3/34 | 451/380 |

* cited by examiner

*Primary Examiner* — Joel D Crandall
(74) *Attorney, Agent, or Firm* — Carlson, Gaskey & Olds, P.C.

(57) ABSTRACT

A disclosed blade sharpening assembly includes at least one track and a shuttle including a hold portion and a guide portion configured to hold a blade edge against the sharpening surface and a support portion configured to align the guide portion relative to the sharpening surface and guide movement of the shuttle.

14 Claims, 19 Drawing Sheets

BLADE SHARPENING ASSEMBLY

REFERENCE TO RELATED APPLICATION

This application is a continuation-in-part of U.S. application Ser. No. 17/217,134 filed on Mar. 30, 2021.

TECHNICAL FIELD

The present disclosure relates to an assembly utilized for sharpening a blade, and more specifically an assembly for holding and guiding a blade during sharpening.

BACKGROUND

Knives dull with use and age and require periodic sharpening to retain a desired sharpness. Sharpness of a knife is determined by the edge width and a radius of the edges of the knife. The angle of edges of the knife leading to the edge is also a factor that contributes to the durability and usefulness of a knife. Sharpening of a knife can be accomplished through the use of sharpening stones of different coarseness, grit size and material. There are many different stone configurations that may be utilized. However, with any stone, obtaining a precise and consistent angle is key to using and successfully obtaining a desired edge on any knife.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A blade sharpening assembly according to an exemplary disclosed embodiment includes, among other possible things, at least one track and a shuttle including a hold portion and a guide portion configured to hold a blade edge against the sharpening surface and a support portion configured to align the guide portion relative to the sharpening surface and guide movement of the shuttle.

In another exemplary embodiment of the foregoing blade sharpening assembly, the guide portion and the hold portion orientate a blade at an angle relative to the sharpening surface.

In another exemplary embodiment of any of the foregoing blade sharpening assemblies, the guide portion comprises a surface guiding the blade at a consistent angle relative to the sharpening surface.

In another exemplary embodiment of any of the foregoing blade sharpening assemblies, the hold portion includes a contact point that is spaced apart from the guide portion to define a gap configured to receive a blade.

In another exemplary embodiment of any of the foregoing blade sharpening assemblies, the hold portion is movable relative to adjust a position of the contact point and is aligned on the shuttle by at least one vertical rib received within a corresponding at least one vertical slot, wherein the hold portion is moveable along the shuttle for adjusting the gap to receive blades with different thicknesses.

In another exemplary embodiment of any of the foregoing blade sharpening assemblies, the guide portion includes a guide mount and at least one guide plate that attaches to the guide mount, the at least one guide plate defining a sharpening angle of the blade relative to the sharpening surface.

In another exemplary embodiment of any of the foregoing blade sharpening assemblies, the track includes a recess with drain holes.

In another exemplary embodiment of any of the foregoing blade sharpening assemblies, the guide portion comprises a surface disposed within a plane angled relative to the sharpening surface.

In another exemplary embodiment of any of the foregoing blade sharpening assemblies, a position of the guide portion and the hold portion relative to the sharpening surface are adjustable to define a sharpening angle.

In another exemplary embodiment of any of the foregoing blade sharpening assemblies, the track comprises at least one peripheral channel with longitudinal portions, wherein the longitudinal portions are configured to receive portions of the support portion.

In another exemplary embodiment of any of the foregoing blade sharpening assemblies, the support portion includes at least one stop that contacts an abutment disposed on the at least one track for setting a position of the shuttle relative to the sharpening surface.

In another exemplary embodiment of any of the foregoing blade sharpening assemblies, the shuttle is rotatable relative to the track.

In another exemplary embodiment of any of the foregoing blade sharpening assemblies, the track includes a track width defined between an inner wall and an outer wall and the shuttle includes a curved outer surface that abuts the outer wall.

In another exemplary embodiment of any of the foregoing blade sharpening assemblies, the guide portion and the hold portion define a transverse axis disposed at a draw angle relative to a longitudinal axis.

In another exemplary embodiment of any of the foregoing blade sharpening assemblies, the draw angle is less than 90 degrees and greater than 0 degrees.

In another exemplary embodiment of any of the foregoing blade sharpening assemblies, the draw angle is a direction in which a blade is pulled through the guide portion and the hold portion.

A method of sharpening a blade according to another exemplary disclosed embodiment includes, among other things, placing a shuttle into a track such that a guide portion of the shuttle is supported above a sharpening surface, holding a blade against the sharpening surface between the guide portion and a hold portion of the shuttle, and moving the shuttle along the sharpening surface with an edge of the blade held against the sharpening surface between the hold portion and the guide portion.

Another exemplary embodiment of the foregoing method includes guiding the blade longitudinally along the sharpening surface and drawing the blade transverse to the longitudinal movement of the shuttle.

In another exemplary embodiment of any of the foregoing methods, holding the blade includes pressing on a press surface to push a contact point against one side of the blade and supporting the blade on an opposite side with the guide portion.

Another exemplary embodiment of any of the foregoing methods, including rotating the shuttle relative to a longitudinal axis and drawing the blade along a draw axis transverse to the longitudinal axis, wherein the transverse axis is disposed at a draw angle less than 90 degrees and greater than 0 degrees relative to the longitudinal axis.

Although the different examples have the specific components shown in the illustrations, embodiments of this disclosure are not limited to those particular combinations.

It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
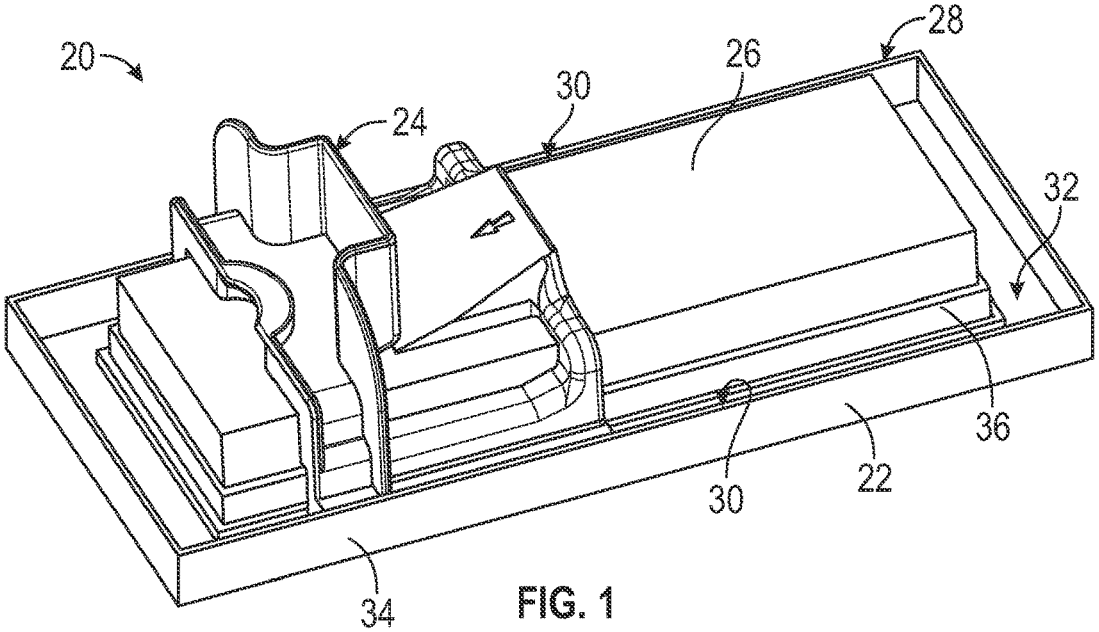
FIG. 1 is a perspective view of an example knife sharpening assembly.

Referring to FIG. 1, a knife sharpening assembly 20 includes a shuttle 24 slidable within a track 22. The track 22 holds a sharpening stone 26 utilized for sharpening an edge of a knife (not shown in FIG. 1). The shuttle 24 includes features that set a sharpening angle as the shuttle 24 is moved longitudinally and the knife is drawn across the sharpening stone 26. The shuttle 24 provides a consistent and repeatable angle for each sharpening stroke to achieve a desired sharpness.

Various examples of each structure and feature of knife and blade sharpening assemblies are disclosed by way of example. Each structure and feature may be provided with integral or separable parts. Nothing in this disclosure should be understood as a disclaimer of either integral or separate embodiments of any of the features. Instead, it is explicitly within the contemplation and scope of this disclosure that any feature may be implemented as either separate parts or integrated into single structures and or portions.

Figure 2:
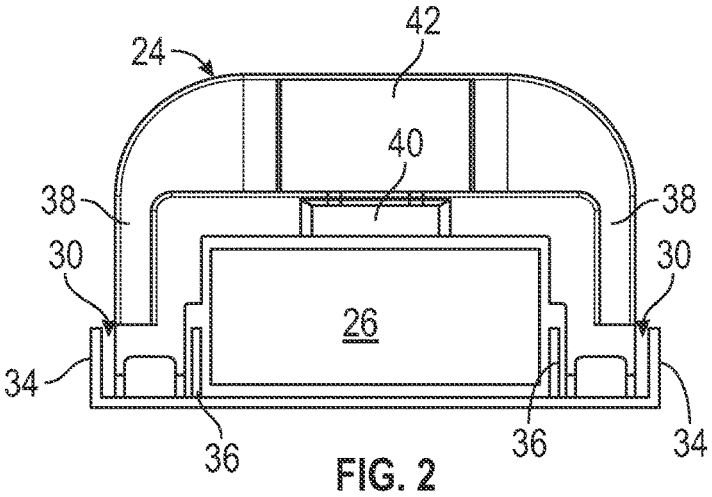
FIG. 2 is a front view of the example knife sharpening assembly.
Figure 3:
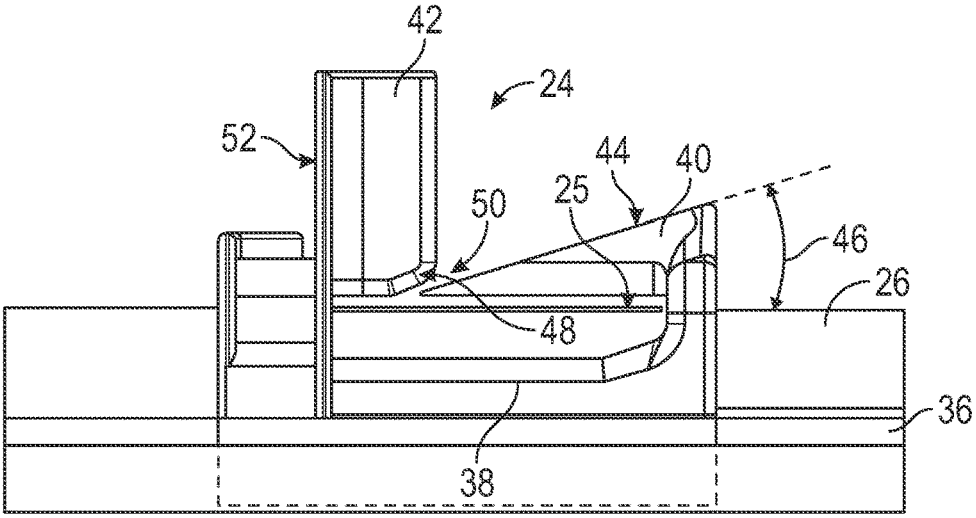
FIG. 3 is a side view of the example knife sharpening assembly.

Referring to FIGS. 2 and 3 with continued reference to FIG. 1, the track 22 includes a peripheral channel 32 that surrounds a center tray area 28. The tray area 28 is sized and configured to hold the sharpening stone 26 in place. The peripheral channel 32 captures and contains any liquids utilized with the sharpening stone 26 during sharpening. The peripheral channel 32 includes longitudinal portions 30 disposed on each longitudinal side of the sharpening stone 26. The longitudinal portions 30 provide a track to guide the shuttle 24 during a sharpening stroke. The longitudinal portions 30 are channels defined by an outer wall 34 and an inner wall 36. A spacing between the outer wall 34 and the inner wall 36 is wide enough to accept the support portion 38 of the shuttle 24.

The shuttle 24 includes support portions 38 that support a guide portion 40 and a hold portion 42 relative to the sharpening stone 26. The guide portion 40 and the hold portion 42 combine to hold and orientate a knife blade against the sharpening stone 26 at a desired angle as the shuttle 24 is moved during a sharpening stroke. The guide portion 40 sets the angle of the knife blade relative to the sharpening surface 25 of the sharpening stone to enable sharpening to a consistent edge angle.

The guide portion 40 includes an angled surface 44 that is disposed at an angle 46 relative to the sharpening surface 25 of the sharpening stone 26. In one disclosed example, the angle 46 is between 8° and 45°. In another disclosed example, the angle 46 is between 25° and 30°. In still another disclosed example, the angle 46 is between 15° and 20°. In another disclosed example, the angle 46 is between 10° and 15°. In another disclosed example, the angle 46 is one of 15°, 17° and 20°. The angle 46 corresponds to the desired angle of the knife edge and may be set to any to provide the desired knife edge. The guide portion 40 is spaced apart from the sharpening surface 25 of the sharpening stone 26 such that the only contact with the sharpening surface 25 is made by the knife to be sharpened.

The hold portion 42 includes a point 48 that is spaced from the angled surface 44 by a gap 50. An edge of a knife to be sharpened is inserted into the gap 50 and against the surface 25 of the sharpening stone 26. The point 48 provides an upper point of contact on a top surface of the knife blade to hold the knife edge against the sharpening stone 26. Moreover, all surfaces of the shuttle 24 are spaced apart from the sharpening stone 26 such that only the knife to be sharpened makes direct contact with the sharpening stone 26.

The holder portion 42 further includes a guard 52 that protects a hand of a user during a sharpening stroke. The guard 52 extends upward in a direction transverse to the sharpening surface 25 of the sharpening stone.

Figure 4:
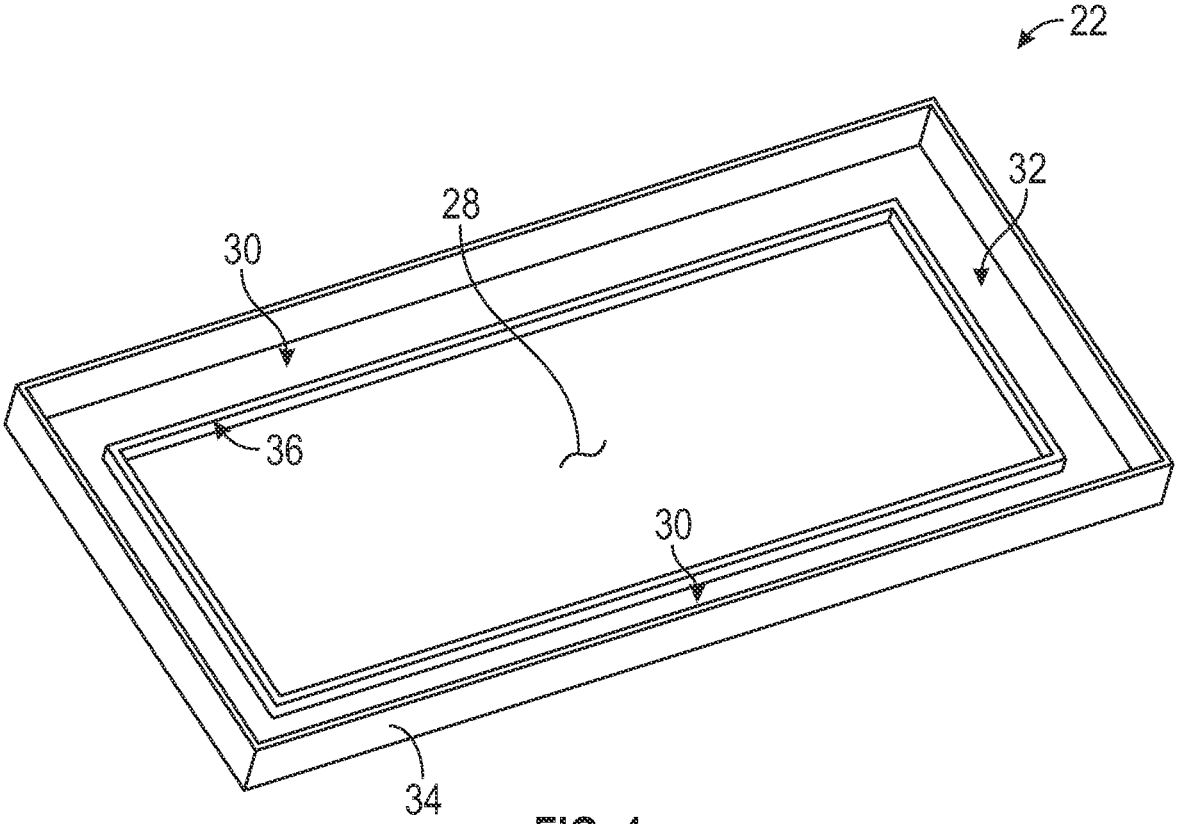
FIG. 4 is a perspective view of an example tray of the knife sharpening assembly.
Figure 5:
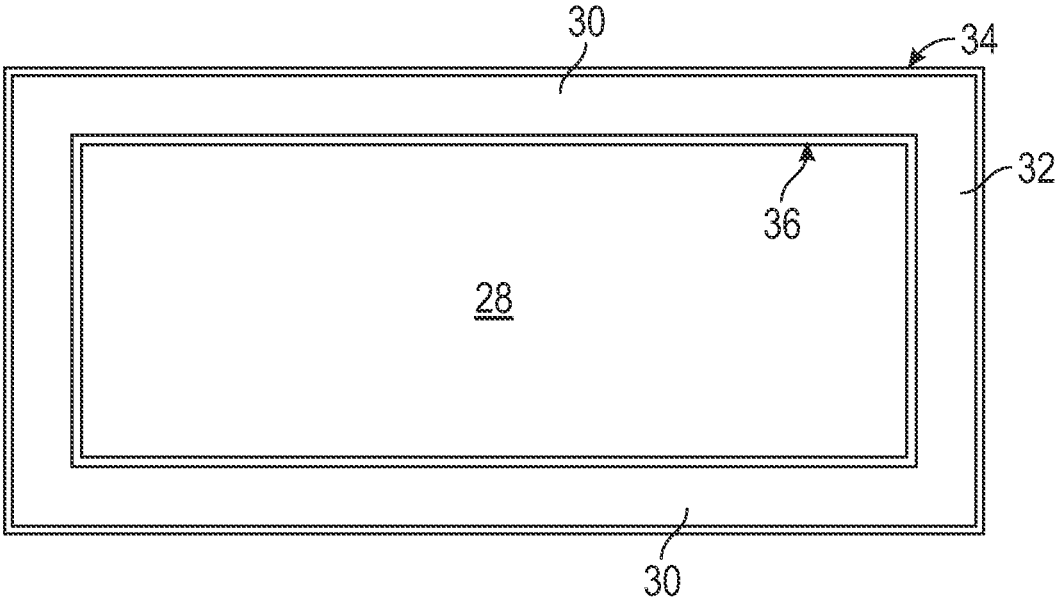
FIG. 5 is a top view of the example tray.
Figure 6:
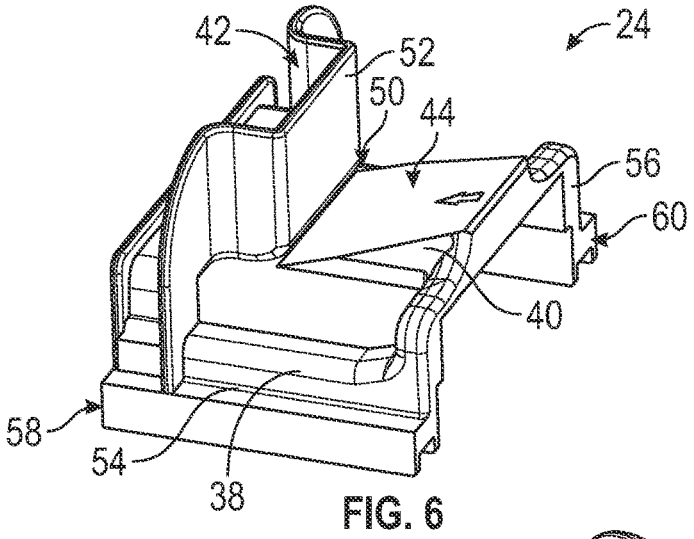
FIG. 6 is a perspective view of a rear side of an example shuttle.
Figure 7:
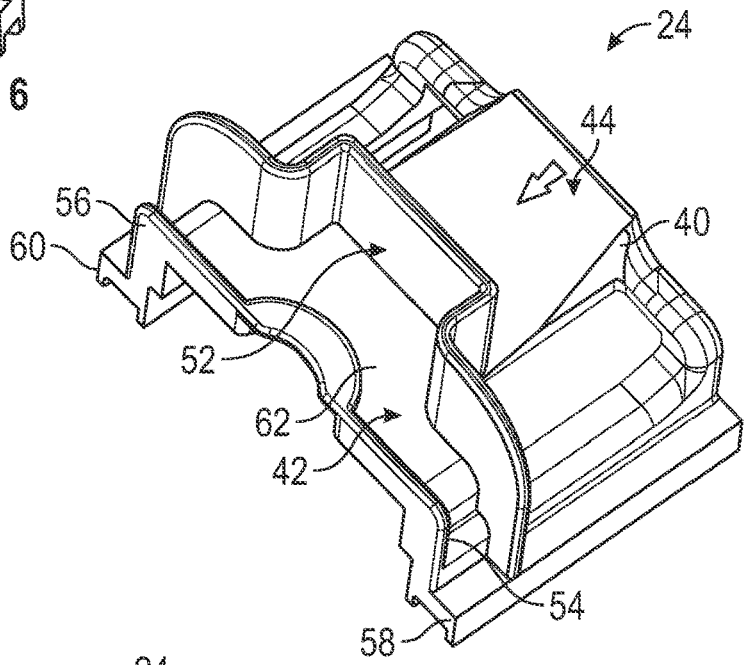
FIG. 7 is a perspective view of a front side of the example shuttle.
Figure 8:
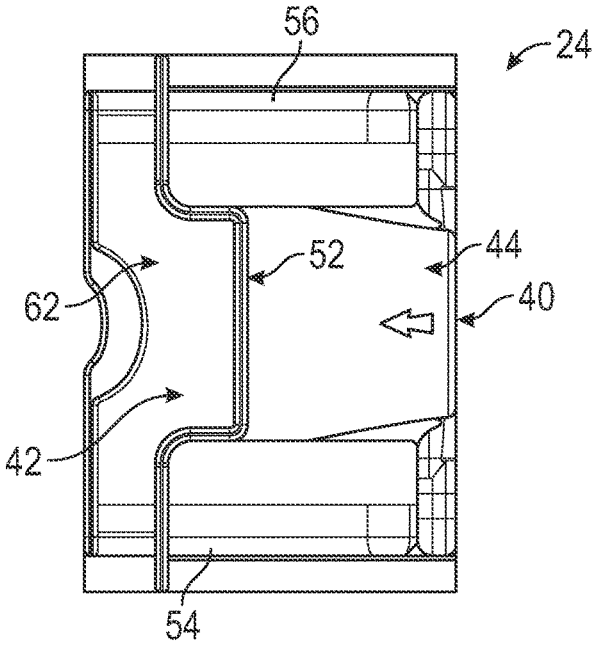
FIG. 8 is a top view of the example shuttle.
Figure 9:
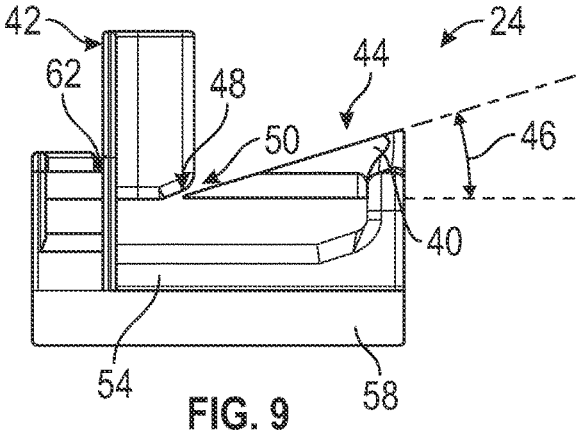
FIG. 9 is a side view of the example shuttle.

Referring to FIGS. 4 and 5, with continued reference to FIG. 1, the example track 22 includes the center area 28 for the sharpening stone 26. The center area 28 is bounded by the inner walls 36. The inner walls 36 extend upward from a bottom surface a height sufficient to hold the sharpening stone 26 in place. The example track 22 is sized to hold a sharpening stone 26 of a common lengths and widths. The length and width defined by the inner walls 36 may be varied within the contemplation and scope of this disclosure. The outer walls 34 are spaced apart from the inner walls 36 to provide a channel for sliding and guiding of the shuttle 24. In this example, the outer walls 34 are higher than the inner walls 36.

Referring to FIGS. 6, 7, 8 and 9 with continued reference to FIG. 1, the disclosed example shuttle 24 is shown and includes the support portions 38 that supports the guide portion 40 and the holder portion 42 relative to the sharpening stone 26. In this disclosed example, the shuttle 24 is a one-piece molded part. However, it is within the contemplation of this disclosure that the shuttle 24 may be formed in multiple parts and with different materials.

The guide portion 40 includes the guide surface 44. It should be appreciated, that although the guide surface 44 is shown by way of example as a flat planer surface, other configurations, such as points that define a plane at a desired angle are also within the contemplation of this disclosure. The guide surface 44 defines a plane at the angle 46 relative to a sharpening stone 26. The angle 46 corresponds with the desired knife edge. Accordingly, the example shuttle 24 provides a set angle and other shuttles could be included to provide different available angles to a user.

The support portion 38 of the example shuttle 24 includes a first leg 54 and a second leg 56 that each extend downward from the guide portion 40 and the holder portion 42. At an end of the first leg 54 is a foot 58 that is of a width corresponding to the longitudinal portions 30 of the track 22. The second leg 56 includes a second foot 60 that fits into another longitudinal portion 30 of the track 22.

The holder portion 42 includes the guard 52 and a press surface 62 for holding the shuttle 24 within the track 22 and a knife blade against the guide surface 44 and the sharpening stone 26. The press surface 62 is disposed on an opposite side of the guard 52 from the contact point 48. Pressing on the press surface 62 maintains the desired orientation of a knife on the shuttle 24. The press surface 62 may be compliant to enable some bending of the holder portion 42 to provide for further application of pressure on a knife blade.

Figure 10:
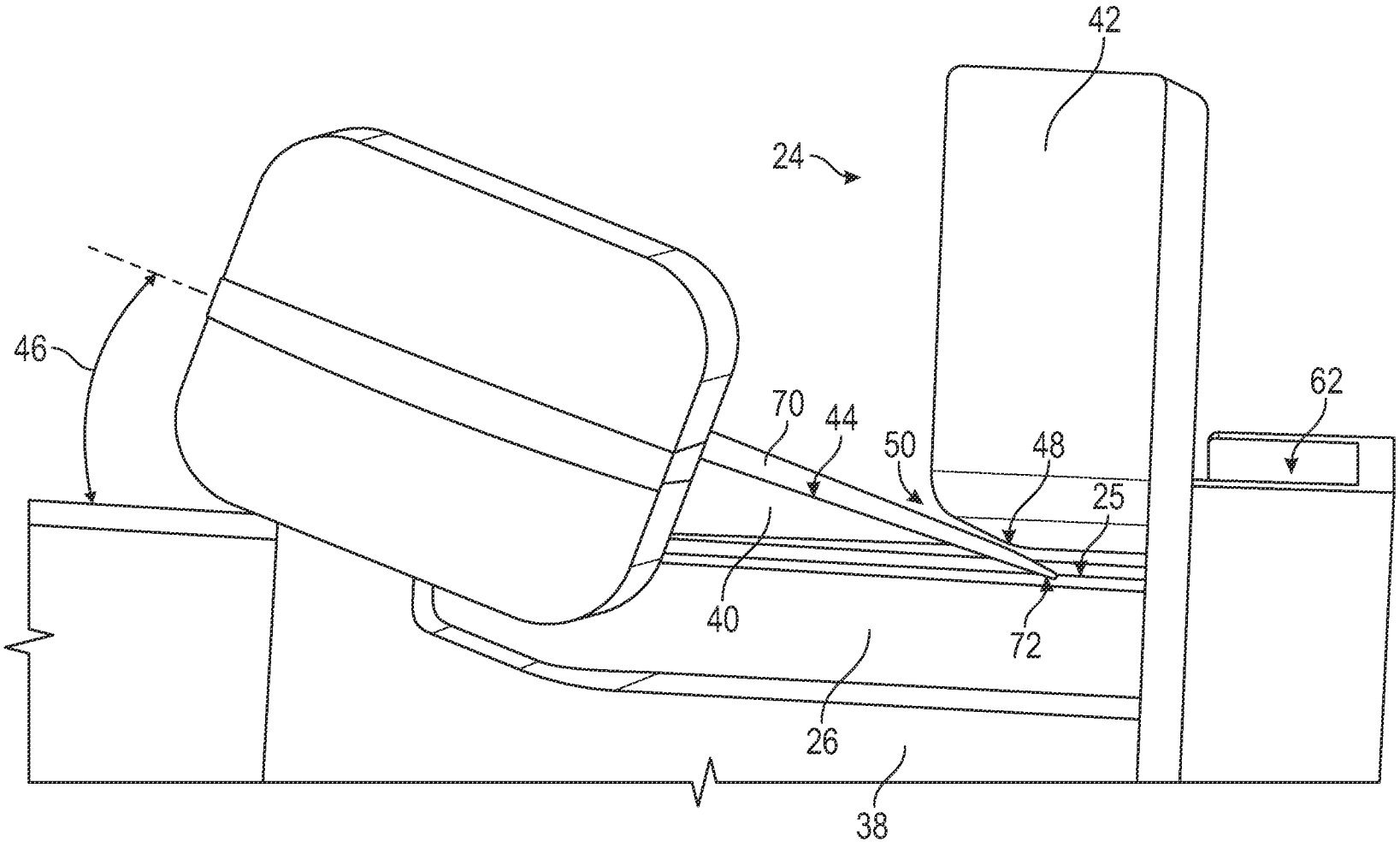
FIG. 10 is a side view of a knife disposed within an example shuttle of the knife sharpening assembly.

Referring to FIG. 10, a knife blade 70 is shown supported on the angled surface 44 and within the gap 50. The knife blade 70 includes an edge 72 that is held against the sharpening surface 25 of the sharpening stone 26. The contact point 48 abuts the knife blade 70 on a top side to force and hold the edge 72 against the sharpening stone 26. The shuttle 24 does not contact the sharpening surface 25 of the sharpening stone 26. The only contact is by the edge 72 of the knife. The entire blade 70 is held at the angle 46 to place the edge into contact with the sharpening stone 26. The angle 46 sets the angle that will be created at the edge 72 by sharpening strokes over the sharpening surface 25.

Figure 11:
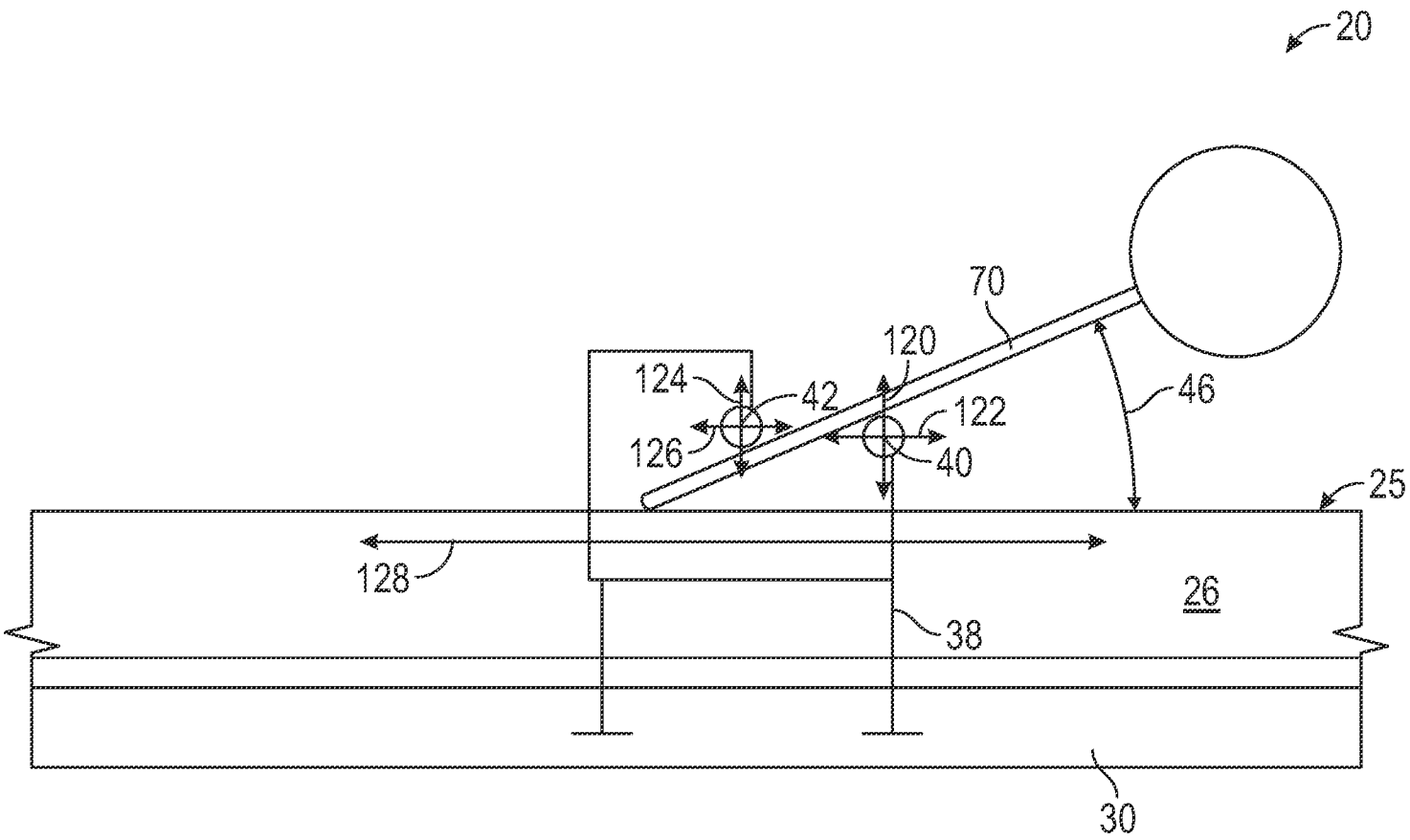
FIG. 11 is a schematic illustration of an example sharpening assembly.

Referring to FIG. 11 with continued reference to FIG. 10, the example sharpening assembly 20 is schematically shown. The assembly 20 includes the guide portion 40 and the hold portion 42 that are positioned relative to each other and to the sharpening surface 25 to set the sharpening angle 46. The position of the guide portion 40 and the hold portion 42 are provided by the schematically shown support 38. The support 38 is moveable longitudinally as indicated by arrow 128 forward and back along the sharpening surface 25. In this example, the sharpening surface 25 is part of a sharpening stone 26, however, it is within the contemplation of this disclosure that the sharpening surface 25 may be any surface utilized to sharpen a knife blade.

The position of the guide portion 40 and the hold portion 42 may be varied to adjust the sharpening angle 46. A position of one or both the guide portion 40 and the hold portion 42 can be altered to set the sharpening angle 46. The guide portion 40 may be positioned at a location forward or back of the illustrated position in a direction indicated by arrow 122. The guide portion 40 may also be positioned above or below the illustrated position in a direction indicated by arrow 120 and or some combination of the horizontal and vertical movement to adjust the sharpening angle 46. Similarly, the hold portion may be altered horizontally in the direction indicated by arrow 126 and/or vertically as indicated by arrow 124 to provide the desired sharpening angle 46.

Moreover, although a disclosed example guide portion 40 and hold portion 42 are shown as surfaces, each may be comprised of a point contact with the blade 70 or a series of points that are capable of supporting the blade 70 in the desired orientation.

The blade 70 contacts the sharpening surface 25 at the angle set by the guide portion 40 and the hold portion 42. Accordingly, three points of contact are utilized to orientated the blade 70 for sharpening. The three points include the sharpening surface 25, the guide portion 40 and the hold portion 42. The blade 70 is moved longitudinally along the sharpening surface 25 back and forth in the direction indicated by arrow 128. The orientation of the guide portion 40 and the hold portion 42 provide for further movement transverse to the direction indicated by arrow 128 in order to engaged an entire length of the blade 70 during a sharpening stroke.

It should be understood, that the example disclosed features may be supported and oriented in many different ways within the scope and contemplation of this disclosure such that the form of the guide portion 40, hold portion 42 and the support portion 38 provides the desired consistent and repeatable orientation of the blade 70 to the sharpening surface 25.

Figure 12A:
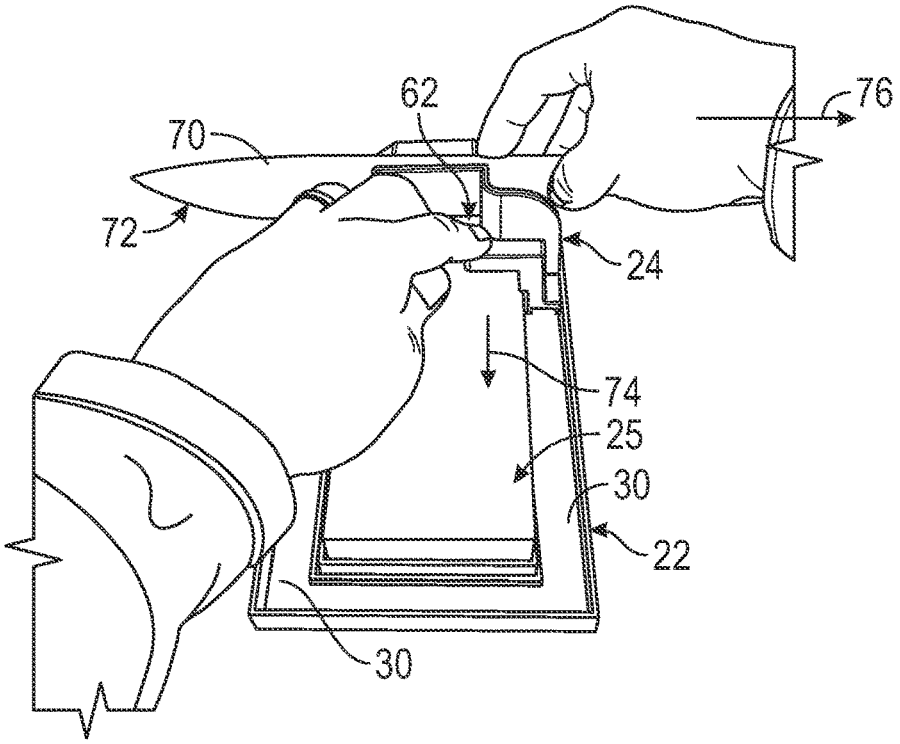
FIG. 12A is a top view of an initial position when sharpening a knife with the example knife sharpening assembly.

Referring to FIG. 12A with continued reference to FIGS. 10 and 11, an initial step in a sharpening process according to an example embodiment is shown. In the initial step, the blade 70 is inserted into the shuttle 24 as is shown in FIG. 10. The user places the blade 70 such that one end is at an edge of the sharpening stone 26. In this example, the user has placed the blade 70 with the end closest to the handle within the shuttle 24. The user will then press down on the press surface 62 with a pressure sufficient to hold the shuttle 24 within the longitudinal channels 30.

The pressure applied by the user provides for holding the shuttle 24 in place and also for holding the knife blade 70 against the sharpening surface 25. Pressure on the knife blade 70 is provided through the contact point 48 of the holder portion 42 (Best shown in FIGS. 10 and 11). The user draws the shuttle 24 longitudinally along the sharpening surface 25, while drawing the knife blade 70 transverse across the sharpening surface 25. During the sharpening stroke, the knife edge 72 is held in the orientation shown in FIG. 10.

Figure 12B:
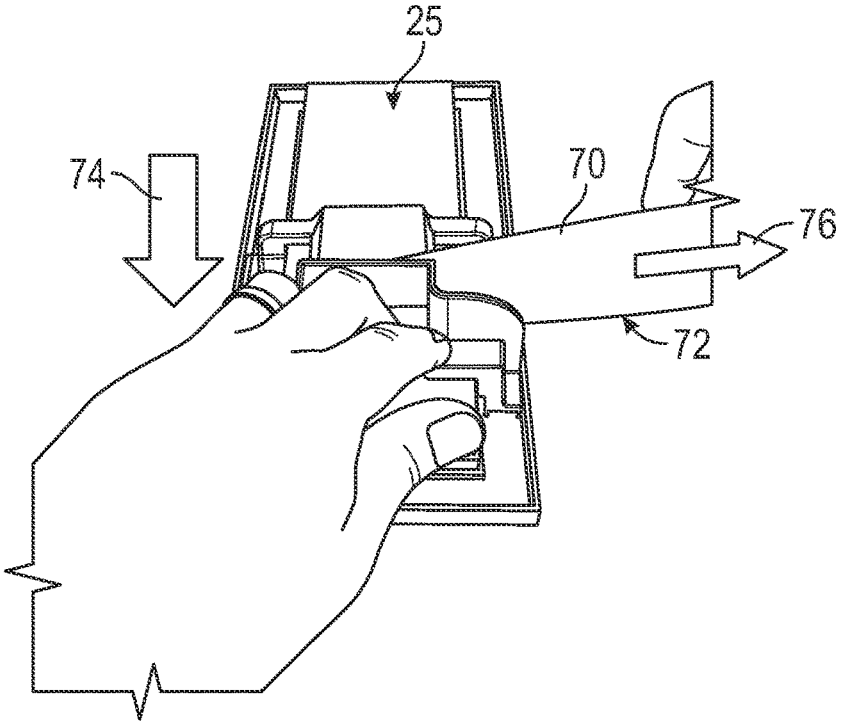
FIG. 12B is a top view during a sharpening stroke of a knife within the knife sharpening assembly.

Referring to FIG. 12B, the shuttle 24 and knife blade 70 are shown during a sharpening stroke that began at the initial position shown in FIG. 12A. The knife blade 70 is held against the sharpening stone surface 25 at all times by pressure applied by the user against the press surface 62. The shuttle 24 is drawn toward the user in the direction indicated by arrow 74. At the same time, the user draws the knife blade 70 in the transverse direction indicated by arrow 76 across the sharpening surface 25. The transverse movement of the knife blade 70 in the direction 76 draws the entire edge 72 of the knife along the sharpening surface 25. The transverse movement 76 is concurrent with the longitudinal movement in the direction indicated by 74 in this example.

The movement in the direction 74 can be for the entire length of the sharpening stone 26, or for a partial length. Additionally, the transverse movement 76 may only be for part of the knife blade 70. However, a smooth sharpening stroke along the entire length of the edge 72 provides the most efficient formation of a sharp edge 72. The process is repeated until a desired sharpness to the knife is attained. In this disclosed example, the blade 70 is drawn across the sharpening surface in the direction indicated at 76 at angle substantially perpendicular to the longitudinal motion indicated by arrow 74. It should be appreciated, that the blade 70 may be drawn across the sharpening surface at angles other than 90 degrees.

In the disclosed example, the shuttle 24 is drawn toward the user. However, the sharpening stroke may also be performed by moving the shuttle 24 away from the user. In either direction, the user maintains pressure on the press surface 62.

An initial sharpening of a knife blade 70 may require repeated sharpening strokes. Moreover, different grades and coarseness of the sharpening stone 26 may be switched as required to provide a desired sharpness. As appreciated, a course sharpening stone 26 may be initially utilized followed by sharpening stones of finer grades to generate a desired sharpness. Moreover, several grades of compound may be utilized to further enhance the blade edge. Regardless of the grade of the sharpening stone or the use of compounds, the disclosed example sharpening stroke remains substantially the same. Additionally, because the shuttle 24 holds the edge 72 at a consistent, repeatable angle, the edge can be obtained quickly and efficiently.

Figure 14:
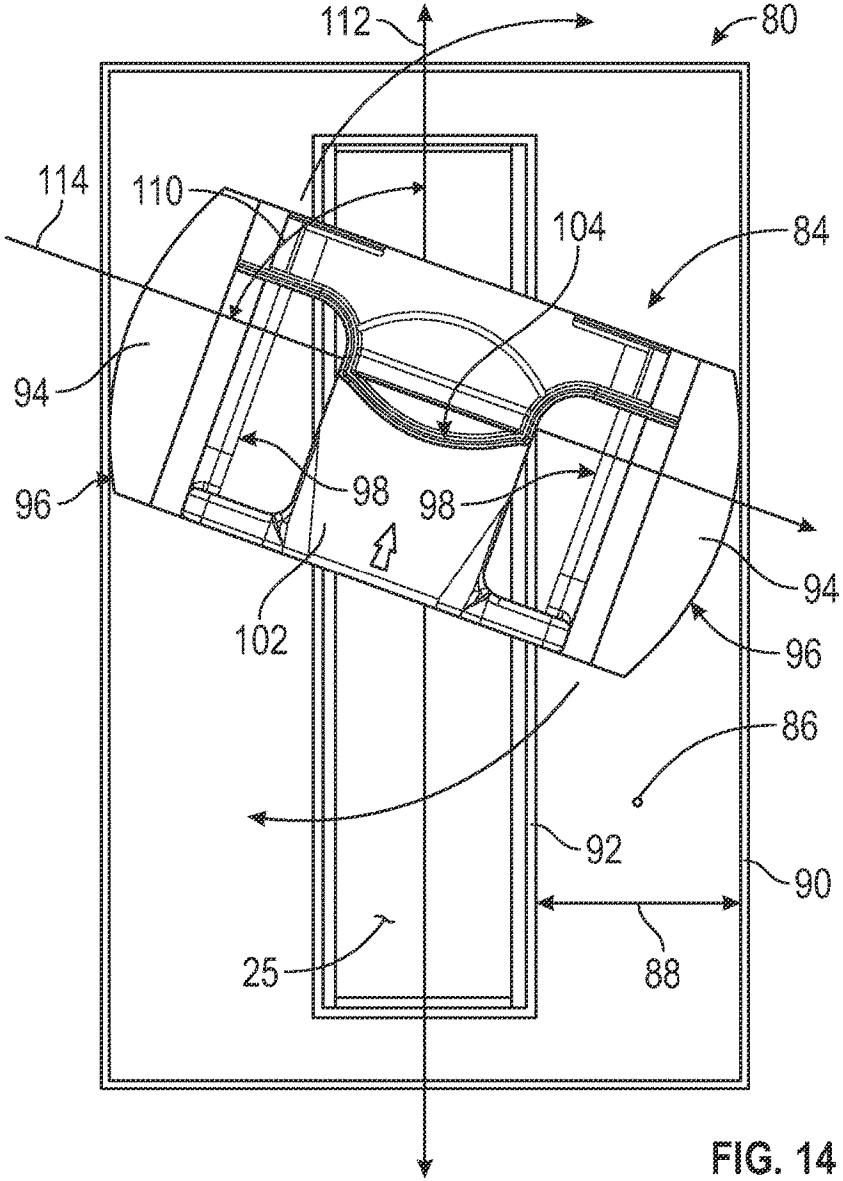
FIG. 14 is a top view of the knife sharpening assembly in another position.
Figure 13:
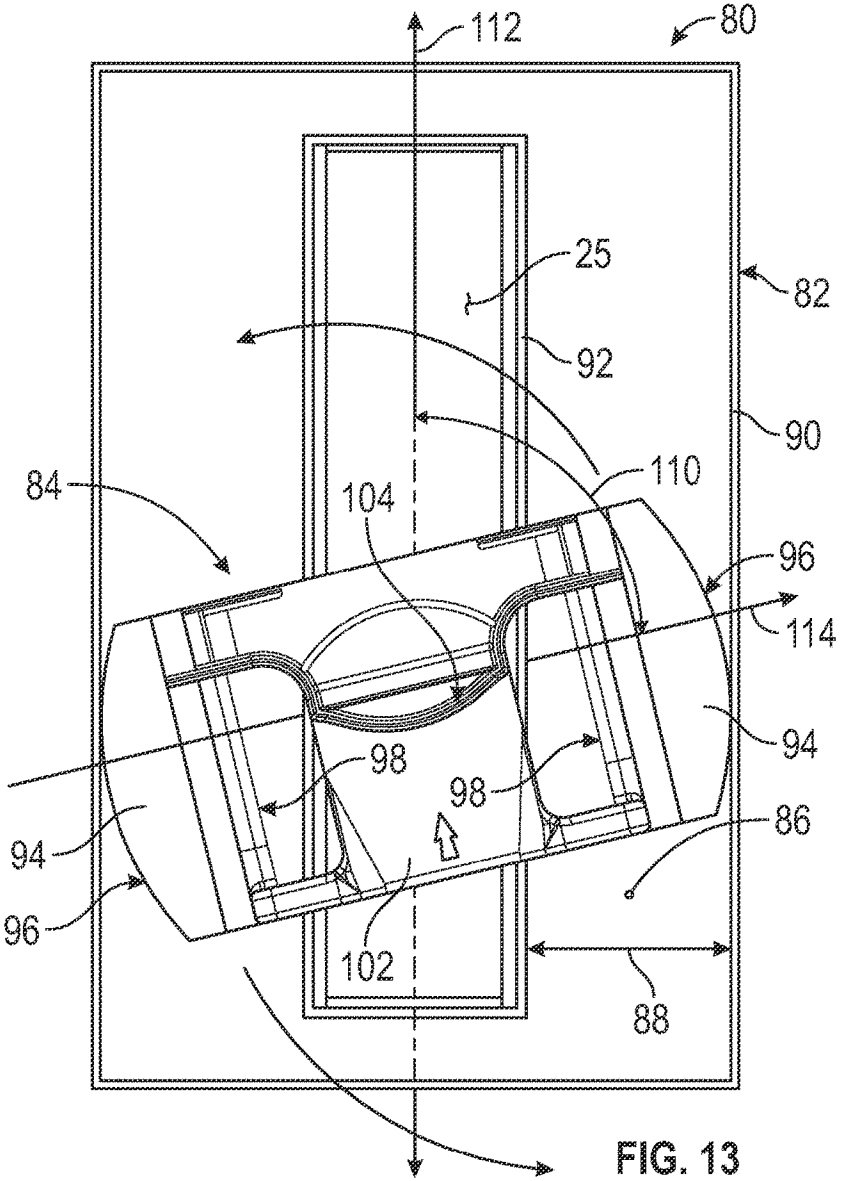
FIG. 13 is a top view of another knife sharpening assembly.

Referring to FIGS. 13 and 14, another disclosed example blade sharpening assembly is indicated at 80 and includes a shuttle 84 movable within a track 82 both longitudinally and rotationally to set an angle 110 of a transverse axis 114 relative to a longitudinal axis 112. In one example embodiment, the angle 110 may be from 0 degrees to less than 90 degrees. In another example embodiment, the angle 110 is between 30° and 60°. In another example embodiment, the angle is around 45°. It should be understood that other angles are within the contemplation and scope of this disclosure.

The shuttle 84 includes a support portion 100 with a foot 96 disposed on either side of a guide portion 102 and a hold portion 104. The foot 96 is disposed within a guide channel 86. The guide channel 86 includes a width 88 defined between an outer wall 90 and an inner wall 92. Each foot 96 includes an outer curved surface 96 and an inner surface 98. Rotation of the shuttle 84 within the guide channel 86 engages the inner surface 98 with the inner wall 92 and the outer curved surface 96 with the outer wall to set the desired angle 110. Altering the width 88 and the radius of the outer curved surface 96 provides for changes to the angle 110. Moreover, the shuttle 84 may be held at any angle between that shown in FIG. 13 and that shown in FIG. 14 to tailor the angle 110 transverse to movement along the axis 112.

Figure 15:
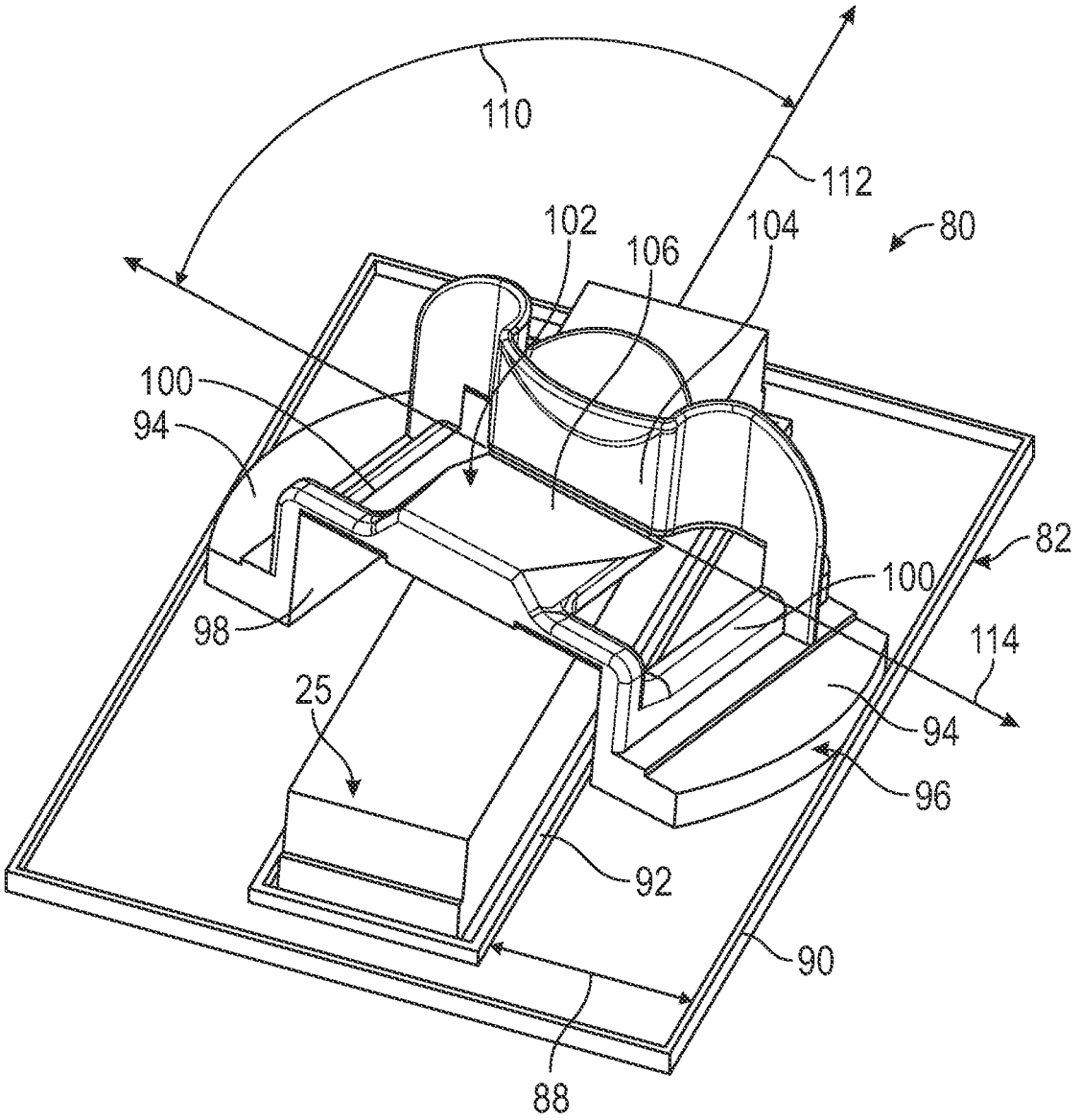
FIG. 15 is a perspective view of the knife sharpening assembly.
Figure 16:
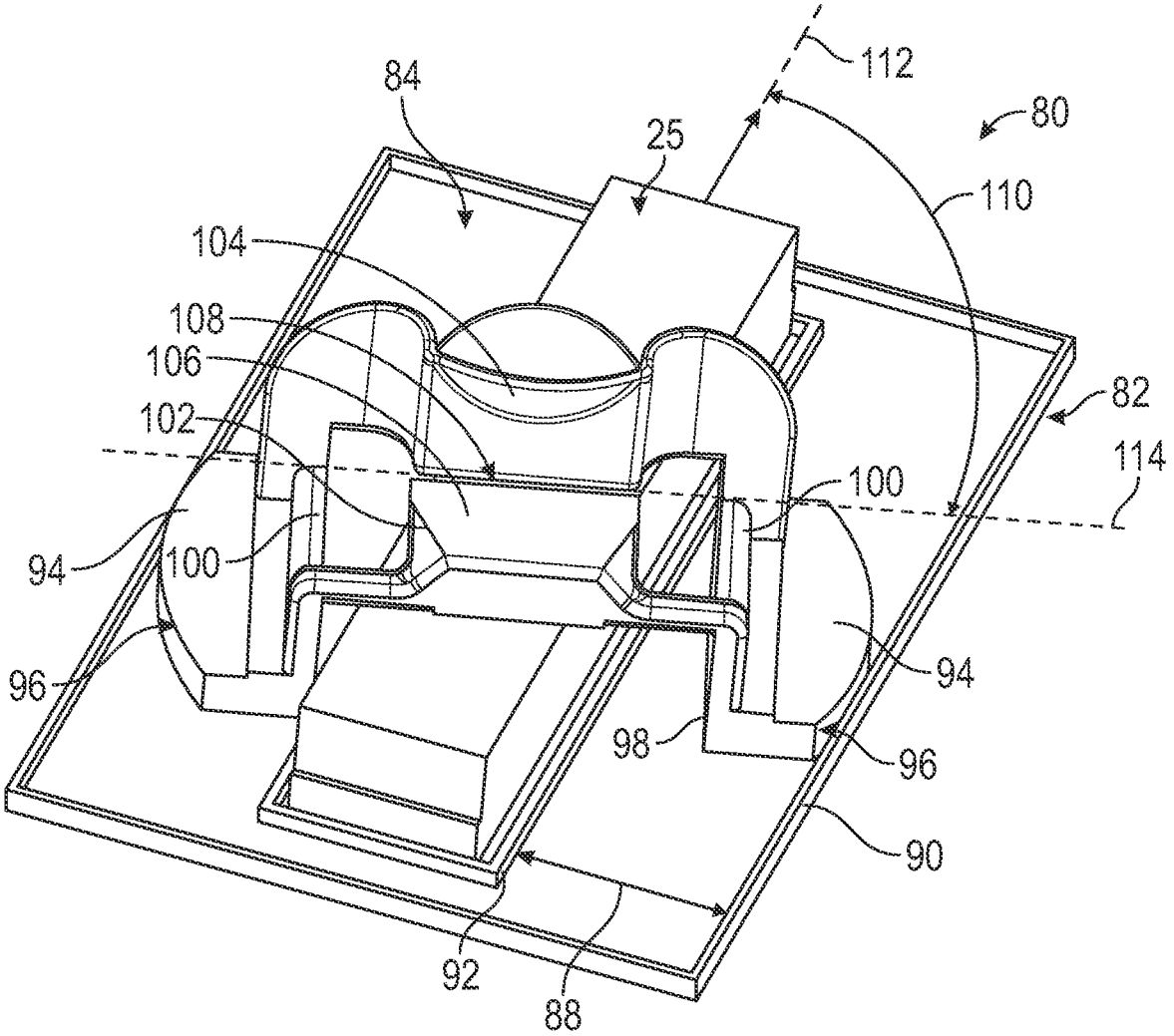
FIG. 16 is another perspective view of the knife sharpening assembly.

Referring to FIGS. 15 and 16, the outer curved wall 96 of each of the feet 94 abuts the outer wall 90 to set the rotational angle 110. During a sharpening stroke, a blade is drawn across the shuttle 84 along the axis 114 at the same time the shuttle 84 is pushed or pulled along the longitudinal axis 112. The guide portion 102 includes an angled surface 106 that defines the sharpening angle of the blade relative to the sharpening surface 25. The hold portion 104 includes a hold point 108 that combined with the angled surface 106 set the sharpening angle. The angled surface 106 of the guide portion 102 and the hold point 108 of the hold portion 108 provide for a consistent and repeatable sharpening angle. Rotation of the shuttle 84 provides increased comfort for a user during a sharpening stroke and also provides a longer surface of the blade to ride across. Moreover, altering an angle of that the blade is drawn across a sharpening surface 25 can lengthen the life of the sharpening surface.

Figure 17:
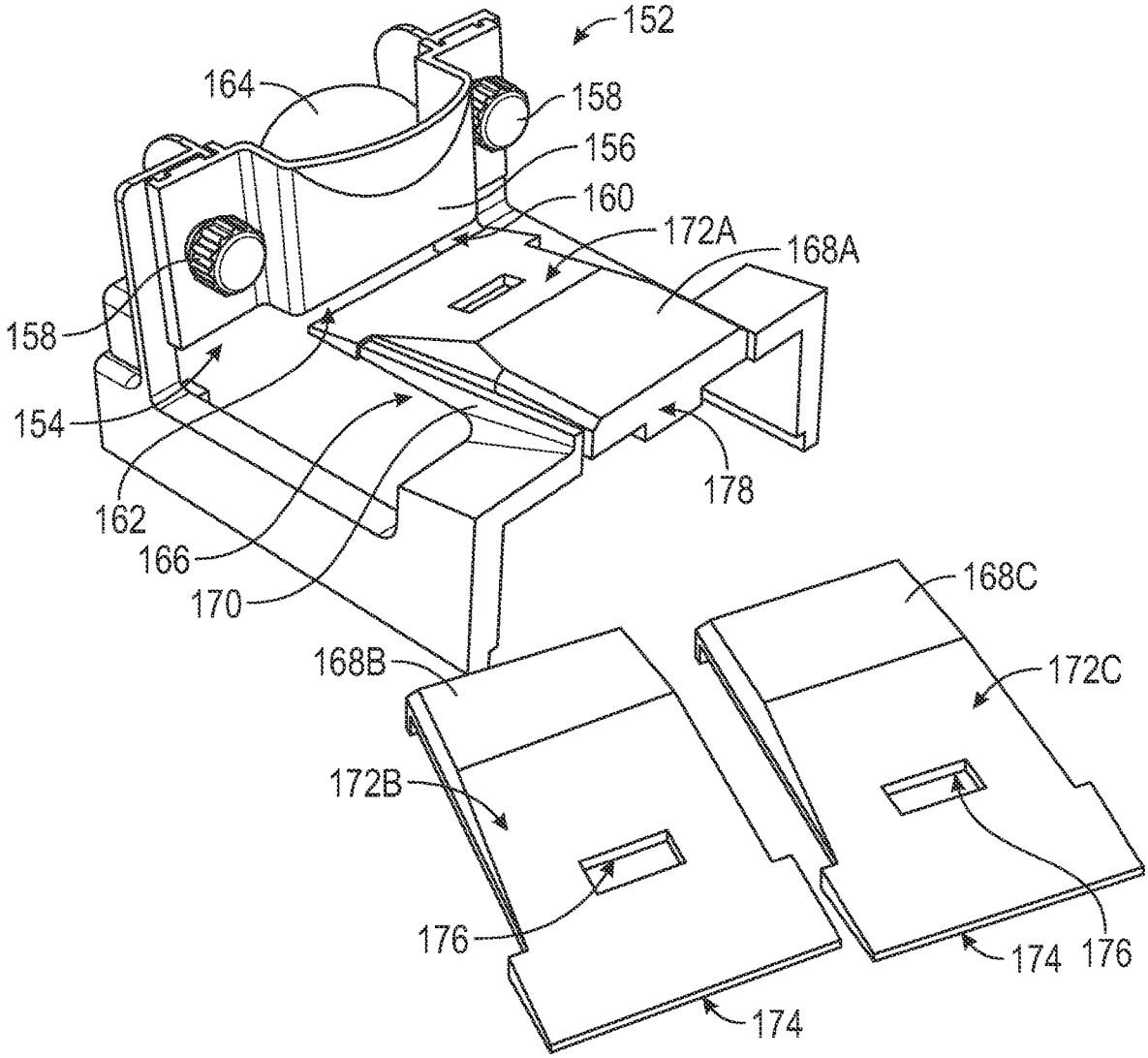
FIG. 17 is a perspective view of another shuttle assembly embodiment.

Referring to FIG. 17, another sharpening assembly 150 includes a shuttle assembly 152 is shown and includes an adjustable hold assembly 154 and a guide assembly 166 that provides an adjustable sharpening angle. The guide assembly 166 includes a plurality of selectable guide plates 168A-C that are attachable to a guide mount portion 170 of the shuttle assembly 152. The guide plates 168A-C define the sharpening angle relative to a sharpening stone. The hold assembly 154 includes a movable hold slide 156 that provides for adjustment of a gap 160 to accommodate blades of different thicknesses.

Figure 18:
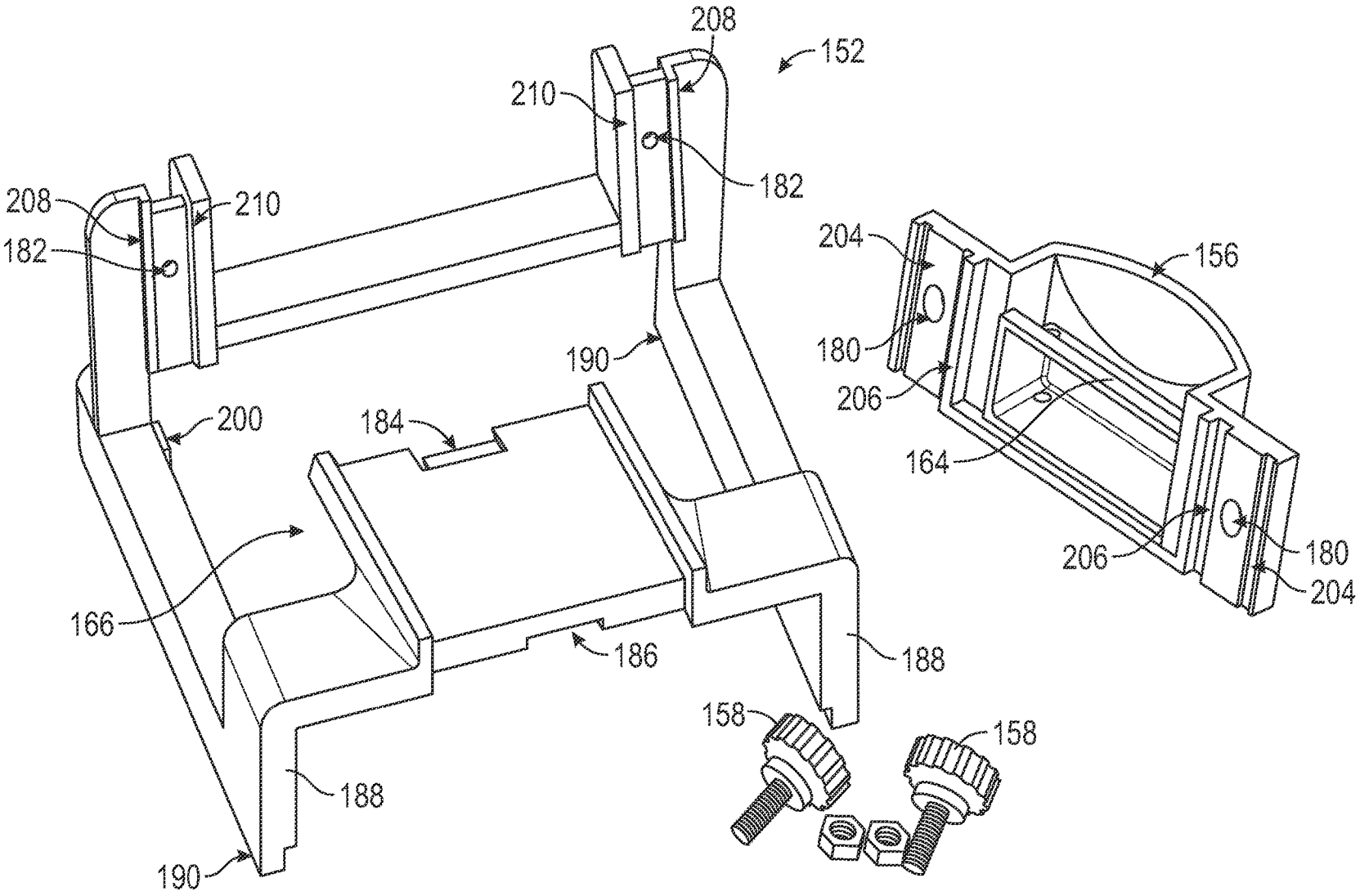
FIG. 18 is a perspective view of the shuttle assembly embodiment with an adjustable holder assembly.
Figure 19:
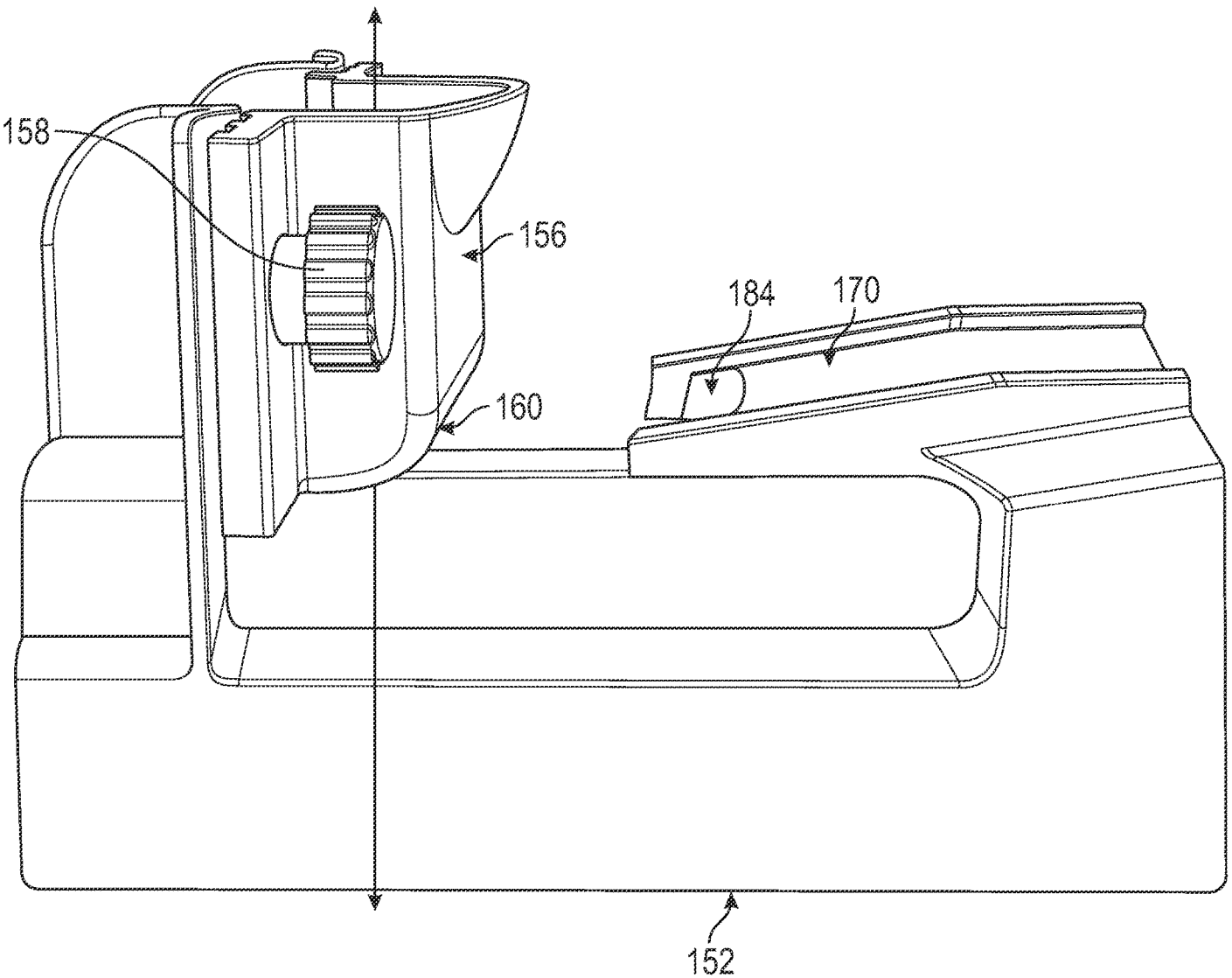
FIG. 19 is a side view of the example shuttle assembly embodiment.

Referring to FIGS. 18 and 19, with continued reference to FIG. 17, the hold slide 156 is moveably attached to the shuttle assembly 152 to enable adjustment. The hold slide 156 includes inner vertical slots 206 and outer vertical slots 204. The shuttle includes inner vertical ribs 210 and outer vertical ribs 208. The inner vertical ribs 210 are received within the inner vertical slots 206 and the outer vertical ribs 208. The mating engagement between the vertical slots 204, 206 and vertical ribs 208, 210 aligns the hold slide 156 relative to the sharpening surface while providing for adjustment to accommodate blades of different thicknesses. It should be appreciated, that although the vertical ribs 208, 210 are provided on the shuttle 152 and the vertical slots 204, 206 provided on the hold slide 156, the features may be reversed within the scope and contemplation of this disclosure. Moreover, although two slots and ribs are disclosed by way of example, one or more mating slots and ribs could be utilized within the scope and contemplation of this disclosure.

In this example embodiment, threaded fasteners 158 are utilized to hold the hold slide 156 to the shuttle assembly 152. In this example the threaded fasteners are knobs, however, other fasteners could be utilized. The hold slide 156 includes a hold edge 160 that is spaced apart from the guide plate 168 to define a spacing of the gap 160. The hold slide 156 also includes a handle portion 164 for grasping and moving the shuttle along the sharpening stone.

In this example, the shuttle assembly 152 includes round openings 182 and the hold slide 156 includes slotted openings 180. The slotted openings 180 provide for vertical adjustment of the hold slide 156 to define the spacing of the gap 160. Once the hold slide 156 is placed in a desired vertical position, the fasteners 158 are tightened to secure the slide 156 in place. The spacing of the gap 160 may be adjusted to accommodate blades of different thicknesses. A blade may be placed on the guide plate 168 and the hold slide 156 abutted against the blade and then secured in place to set the gap 160. The gap 160 is set to provide sufficient clearance for the blade to be pulled through the gap 160 while maintaining the blade abutment along the guide plate 168 to hold the desired sharpening angel.

The example guide plates 168A-C set the sharpening angle and are attached to the guide mount portion 170 by a forward and aft snap and tab fit. Each of the guide plates 168A-C include a slot 176 that fits into a forward tab 184 formed as an integral part of the guide mount portion 170. The guide mount portion 170 further includes an aft slot 186 that receives a catch 178 on each of the guide plates 168A-C. Accordingly, each of the guide plates 168A-C are secured at forward and aft locations to the guide mount portion 170. It should be appreciated that although an example snap mount configuration is disclosed by way of example other securement configurations that enable switching of guide plates 168A-C are within the contemplation and scope of this disclosure.

In this example, the guide plates 168A-C define different sharpening angles. In one disclosed example, the guide plate 168A defines an angle of 19.5°, the guide plate 168B defines an angle of 20° and the guide plate 168C defines an angle of 20.5°. As appreciated other angles could be provided by additional guide plates 168. Moreover, the number of guide plates 168 disclosed could vary to provide additional sharpening angles.

Figure 20:
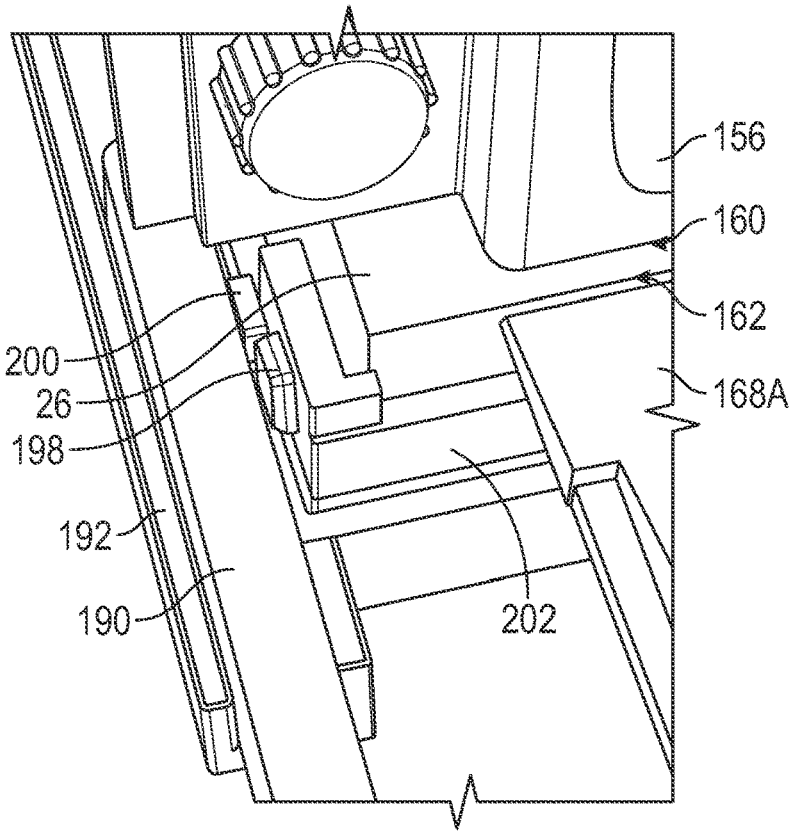
FIG. 20 is a perspective view of an interface between an example shuttle assembly and track in an initial position.
Figure 21:
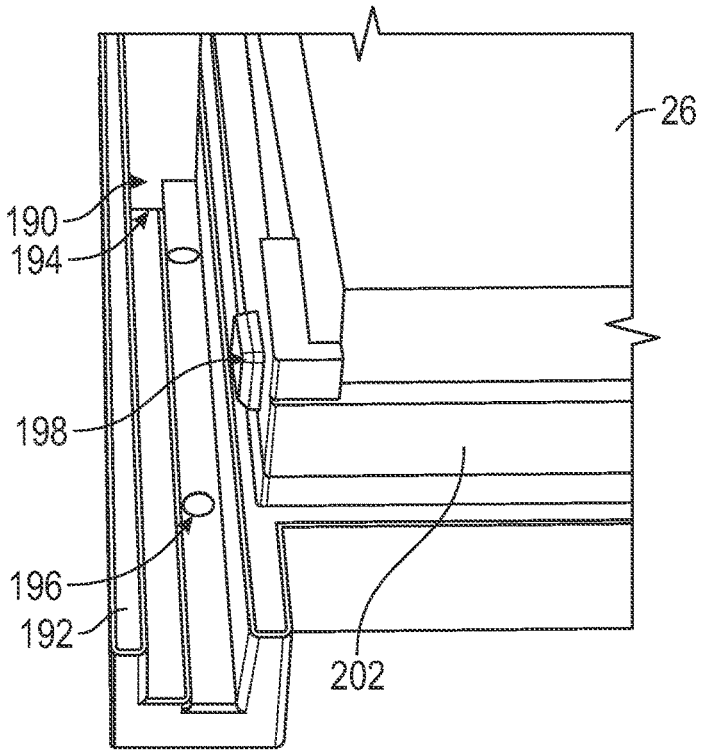
FIG. 21 is another perspective view of an example track assembly.

Referring to FIGS. 20 and 21 with continued reference to FIGS. 17-19, a track 192 includes guide channels 194 on each longitudinal side of a sharpening stone 26. The guide channel 194 includes a longitudinal slot with drain openings 196. Any moisture or fluid from that seeps into the guide channels 194 will drain through the openings 196 so as to not obstruct motion of the shuttle assembly 152. The guide channels 194 are open at each end and receives a foot portion 190 of the shuttle assembly 152. A sharpening stone holder 202 is supported within the track 192. The example foot 190 includes a stepped configuration to provide a clearance fit over the portions of the channel 194 including the drain openings 196. The holder 202 is configured for the specific stone size and may be of different sizes to accommodate different sharpening stones.

An initial start location of the shuttle assembly 152 is set by an abutment 200 that abuts a stop 198. The abutment 200 is part of the shuttle assembly 152 and the stop 198 is part of the holder 202. The abutment 200 abuts the stop 198 to align the gap 160 and a forward edge of the guide plate 168 with an end of the sharpening stone 26. The abutting contact between the stop 198 and abutment 200 positions the shuttle assembly 152 relative to the stone 26 to prevent errant impact between a blade and a side of the stone 26. The example stop 198 and abutment 200 may be integral parts on respective parts or be separate parts attached or otherwise secured to the respective parts.

Figure 24:
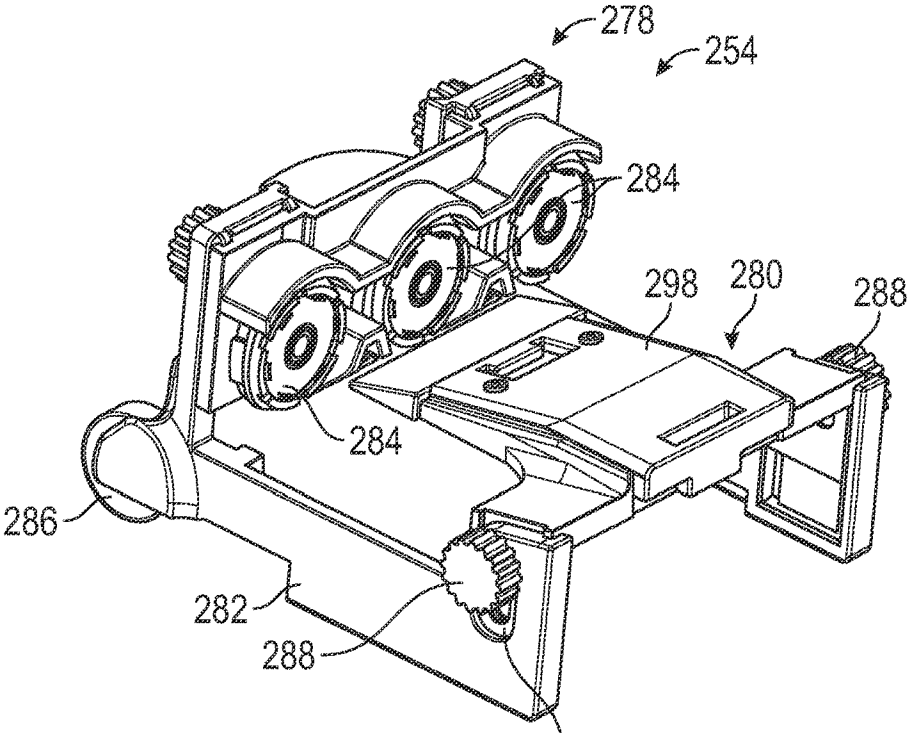
FIG. 24 is a perspective view of a shuttle assembly.
Figure 22:
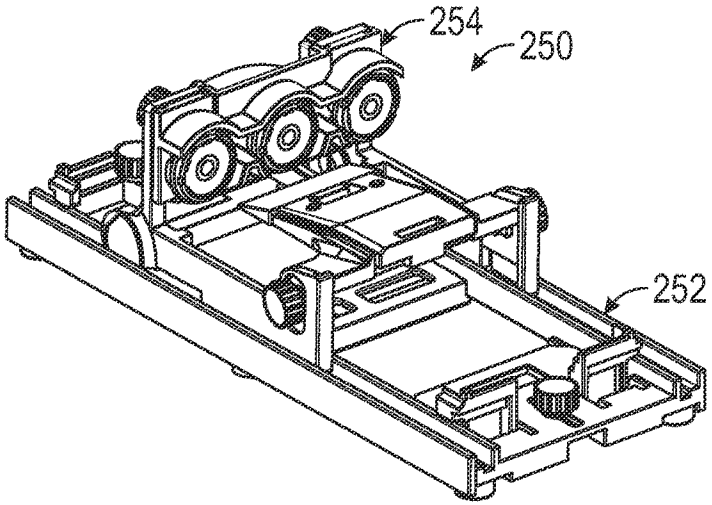
FIG. 22 is a perspective view of another example blade sharpening assembly.
Figure 23:
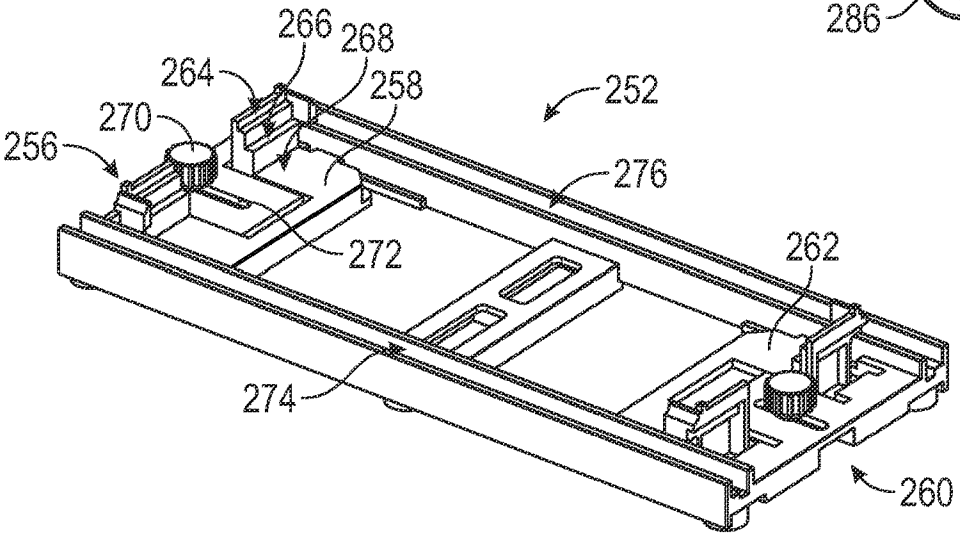
FIG. 23 is a perspective view of an example tray assembly.

Referring to FIGS. 22, 23 and 24, another blade sharpening assembly 250 includes a shuttle 254 slidable relative to a sharpening stone 296 supported within a tray assembly 252. The tray 252 includes ends 256, 260 with movable bracket 258, 262. The movable brackets 258, 262 provide for securement of sharpening stones of differing lengths. The brackets 258, 262 are secured by way of a knob 270 disposed within a corresponding slot 272. The brackets 258, 262 further includes steps 264, 266 and 268 that accommodates a thickness of different sharpening stones. In this disclosed example, there are threes steps 264, 266 and 268, however, any number of steps could be utilized and are within the scope and contemplation of this disclosure.

The tray 252 further include first and second longitudinal tracks 274, 276. The tracks 274, 276 receive and guide the shuttle 254 during sharpening operations. The shuttle 254 includes wheels 286 received within the tracks 274, 276 to reduce friction and provide for smooth movement during a sharpening operation.

The shuttle 254 includes an adjustable hold portion 278 and an adjustable guide portion 280. The hold portion 278 includes rotatable bearings 284 that provide the contact point for holding a blade against a sharpening surface. The guide portion 280 includes an angle plate 298 for setting an angle at which a blade engages the sharpening surface. The angle plate 298 is secured at a desired angle by a knobs 288 disposed within a corresponding slot 290. The shuttle 252 further includes a support portion 282 with a wheel 286. The support portion 282 and wheel 286 fit within tracks 274, 276 of the tray 252.

Figure 25:
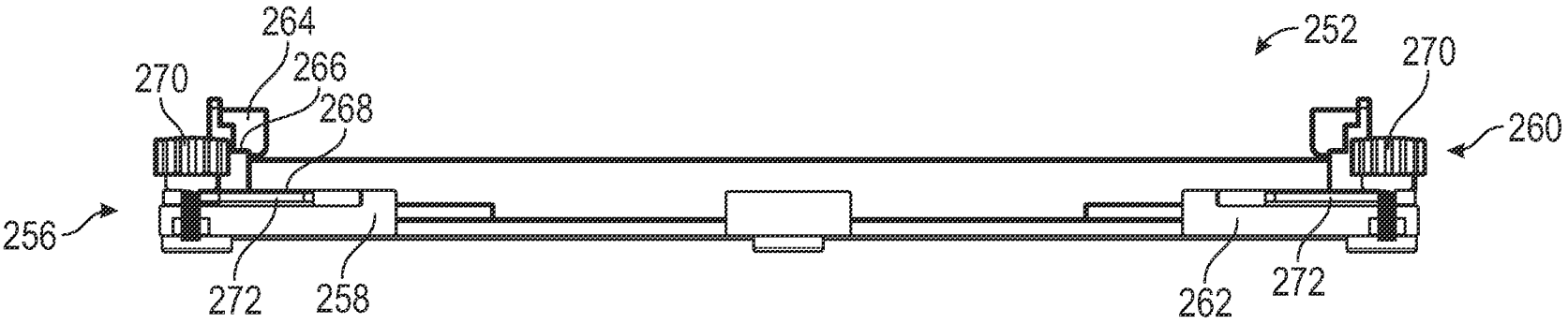
FIG. 25 is side view of the example tray assembly.
Figure 26:
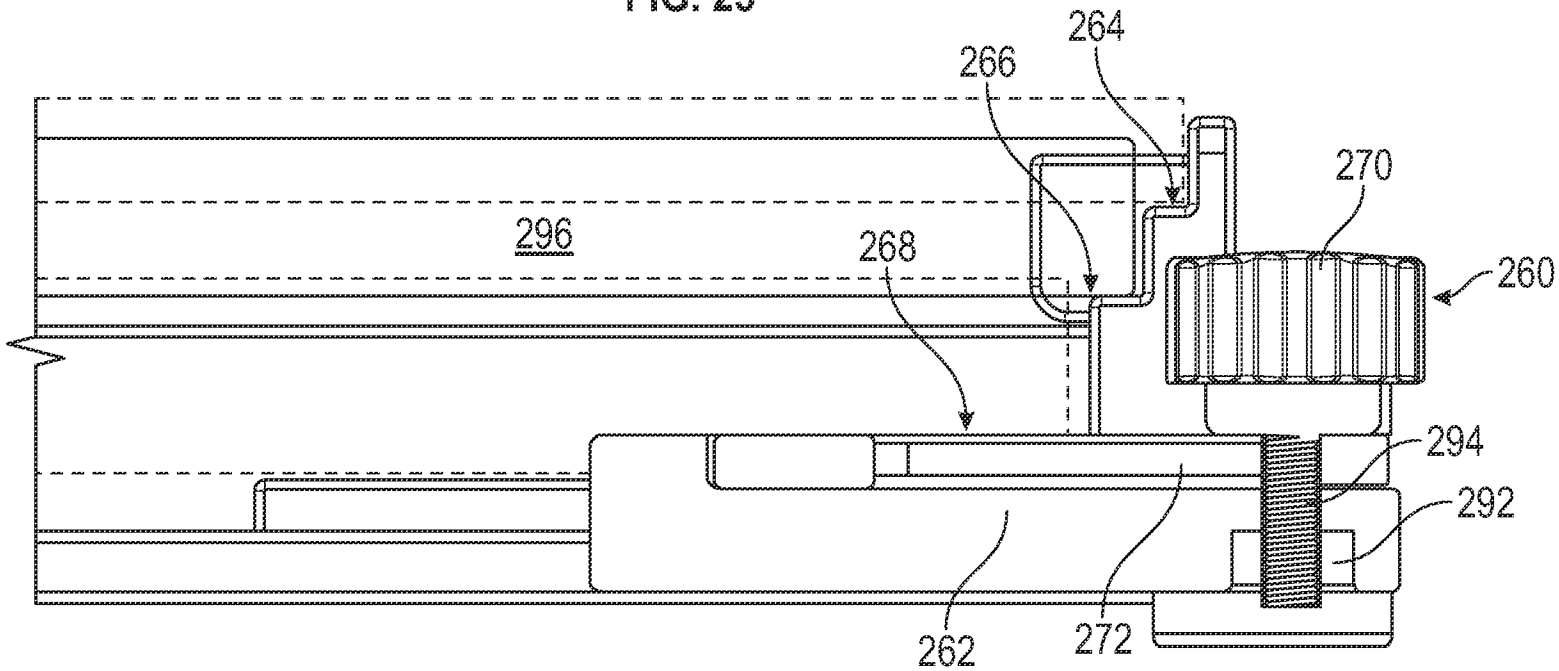
FIG. 26 is an enlarged end portion of the tray assembly.

Referring to FIGS. 25 and 26, the example tray 252 is shown and includes the end brackets 258, 262 at corresponding ends 256, 260. The end brackets 258, 262 are secured in place by a knob 270 that extends through a slot 272 and secured to a threaded member 292. The knob 270 includes a threaded portion 294 that is secured to the threaded member 292 to hold the corresponding end brackets 258, 262 in place.

The side view of the tray 252 shows the steps 264, 266 and 268 that support a sharpening stone 296. Different thicknesses of sharpening stone may be placed on one of the steps 264 to support the sharpening stone 296 at a desired height.

Figure 27A:
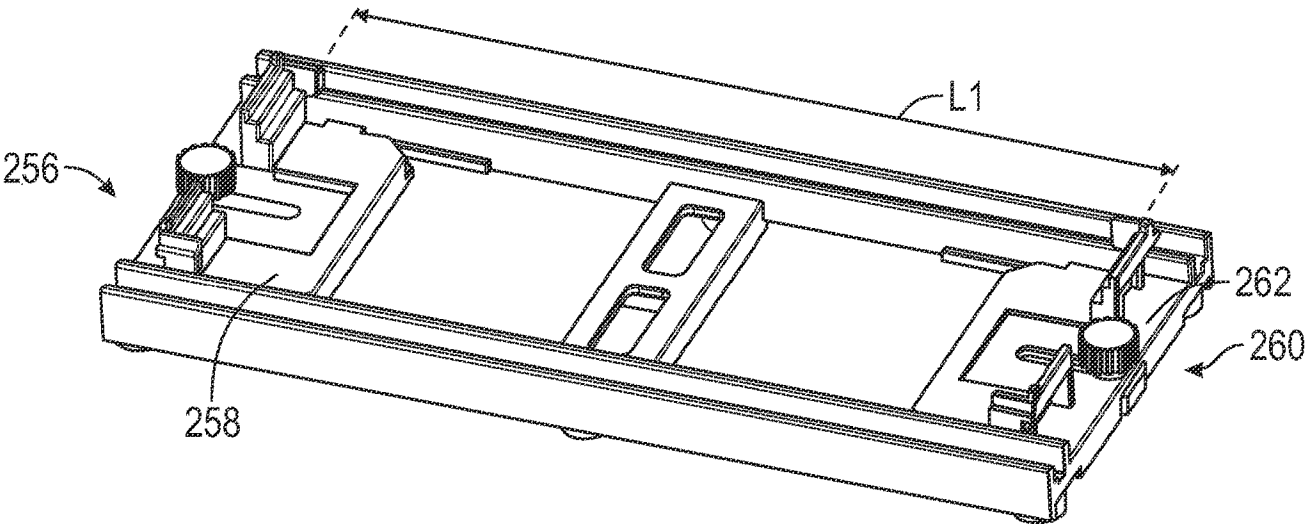
FIG. 27A is a perspective view of the tray assembly with end portions set at a first distance from each other.
Figure 27B:
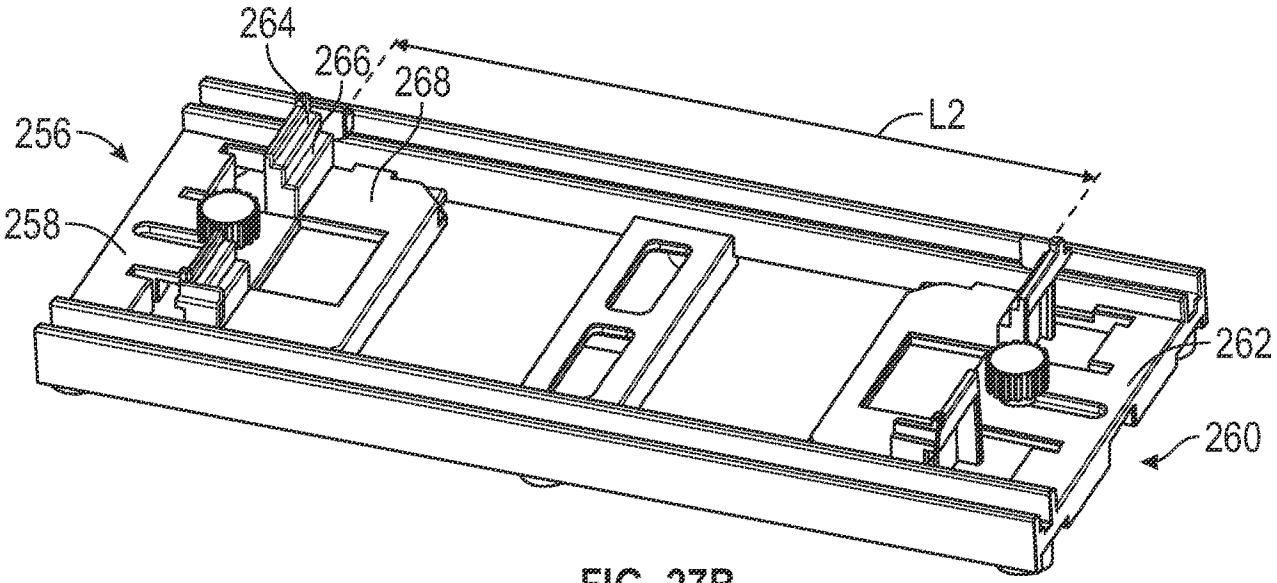
FIG. 27B is a perspective view of the tray assembly with end portions set at a second distance from each other.

Referring to FIGS. 27A and 27B with continued reference to FIGS. 25 and 26, the example end brackets 258 and 262 are moveable linearly to adjust a distance therebetween. FIG. 27A illustrates the first and second end brackets 258 and 260 set to provide a distance L1 therebetween. In this example the distance L1 is the largest distance provided by the tray assembly 256. FIG. 27B illustrates the end brackets 258 and 262 pushed toward each other such that a distance L2 is provided therebetween. The distance L2 is a minimum distance therebetween. The end brackets 258, 262 may be adjusted and secured in place to provide for any length between the maximum length L1 and the minimum length L2 to accommodate sharpening elements of varying lengths.

Figure 28A:
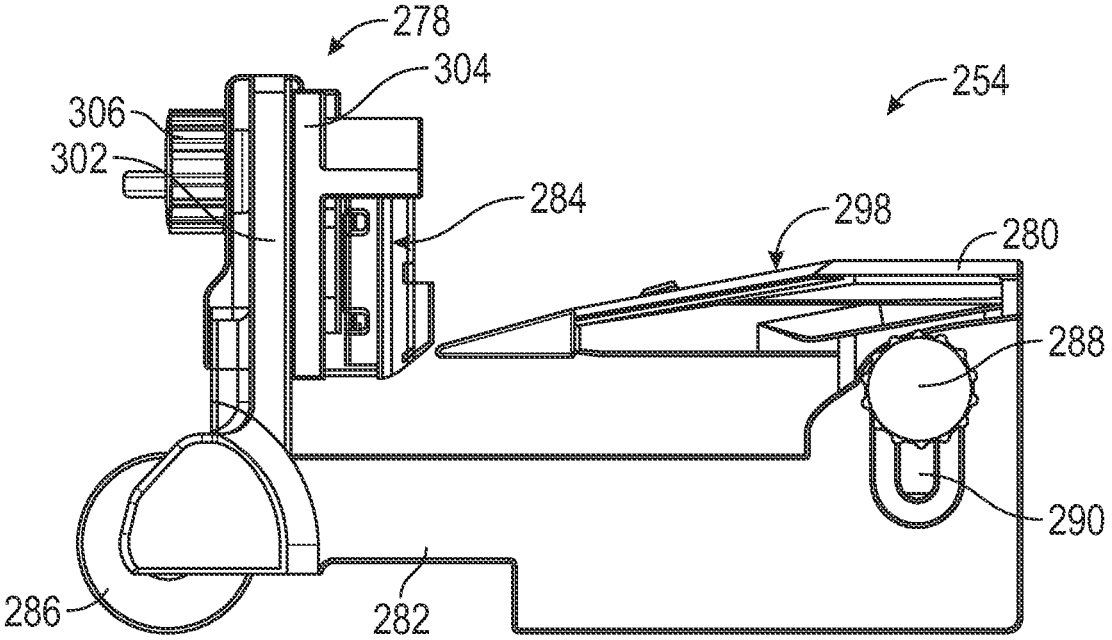
FIG. 28A is a side view of the example shuttle assembly set in an upper position.
Figure 28B:
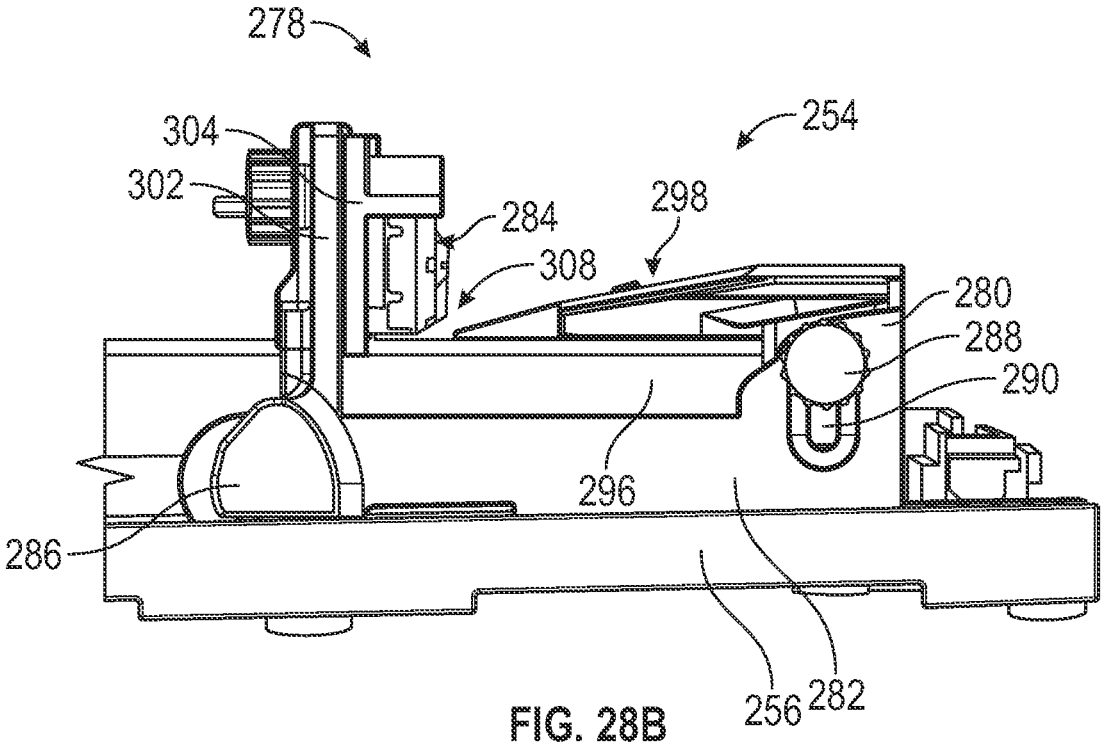
FIG. 28B is a side view of the example shuttle assembly set in the upper position relative to a sharpening stone.

Referring to FIGS. 28A and 28B, the example shuttle 254 is shown in a configuration where the holder portion 278 and the guide portion 280 are both adjusted upward. The example holder portion 278 includes a fixed element 302 and movable element 304 that are held together by threaded knob 306. Once the position of the moveable element 304 is set, the knob 306 is tightened to set the desired height. The bearings 284 are supported on the movable element 304.

The guide portion 280 includes the angle plate 298 that is movable vertically to position the plate 298 relative to the bearings 284. In this disclosed embodiment, the plate 298 is secured in place by a knob 288 that extends through slot 290. Once the angle plate 298 is moved to a desired position, the knob is tightened and the plate 298 remains in the set position. Vertical movement of both the bearings 284 and the angle plate 298 provide for adjustment of the gap 308. The gap 308 is adjusted based on the size, shape, thickness of the blade and the desired angle of the sharpened edge.

The shuttle 254 further includes the support portion 282 that fits within the tracks 274 and 276. The support portion 282 further includes a wheel 286 that reduces friction during movement of the shuttle 254 to provide a more consistent feel and sharpening stroke.

Figure 29A:
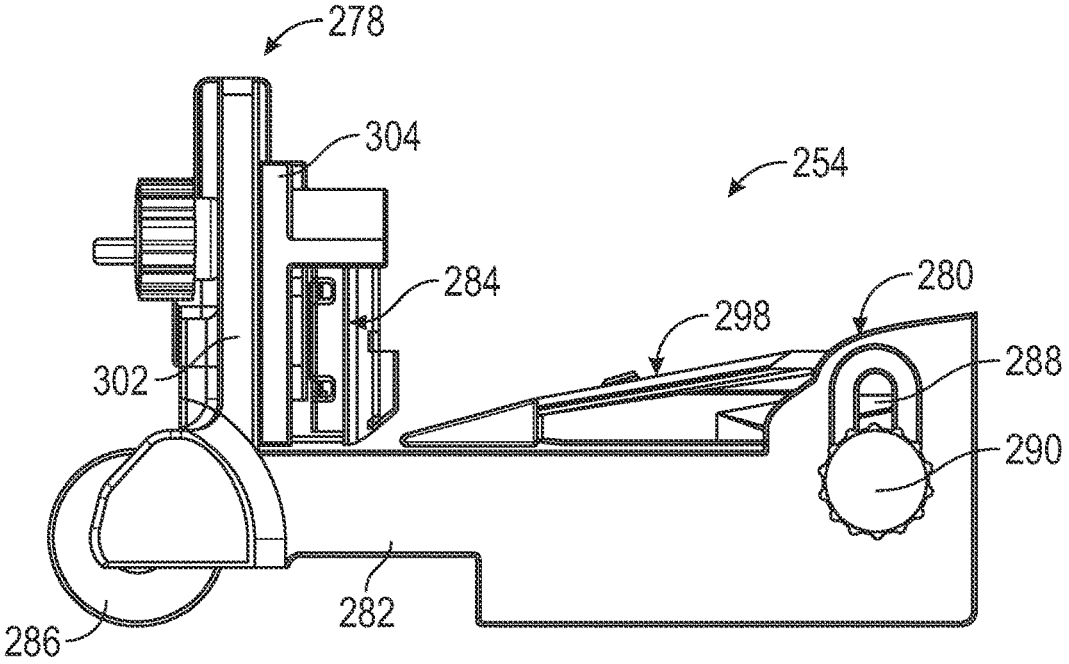
FIG. 29A is a side view of the example shuttle assembly set in a lower position.
Figure 29B:
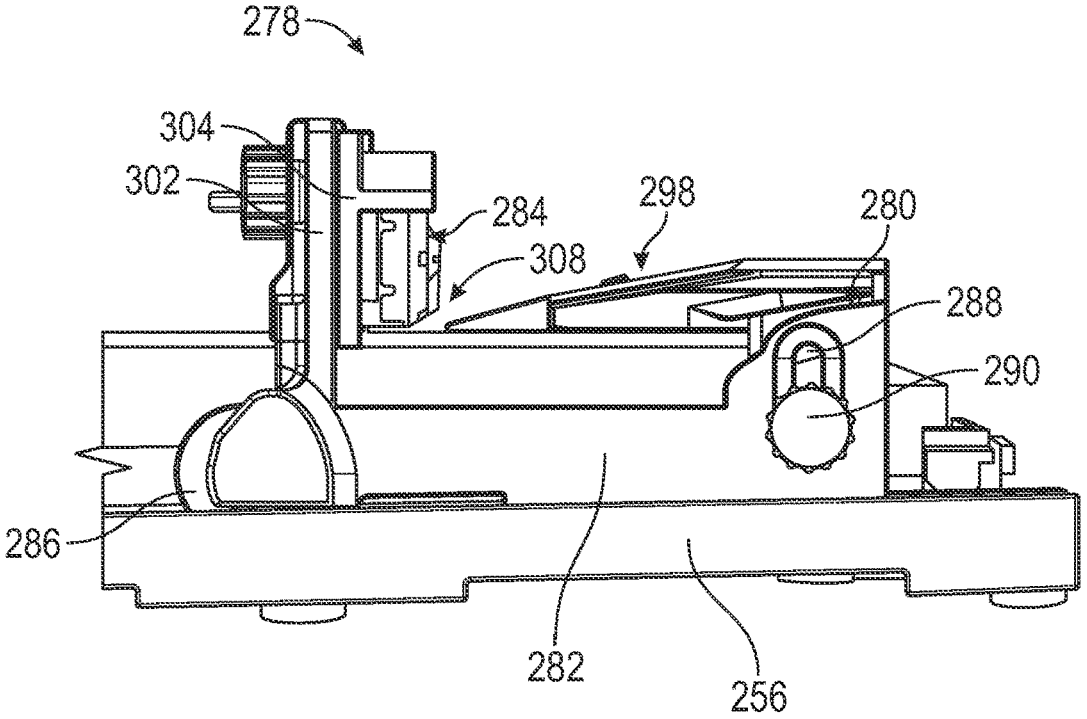
FIG. 29B is a side view of the example shuttle assembly set in the lower position relative to a sharpening stone.

Referring to FIGS. 29A and 29B, the shuttle 254 is shown in a configuration where both the bearings 284 and the angle plate 298 are placed in a lowest position. The bearings 284 and the angle plate 298 are movable to any of an infinite number of positions between the uppermost position shown in FIGS. 28A and 28B and the lower most positions shown in FIGS. 29A and 29B. The many possible positions are provided to accommodate sharpening stones and surface of many different thicknesses. Moreover, the different possible positions also provides for accommodation of blades of different thickness. Additionally, the adjustments provided enable accommodation due to wear of blades and of sharpening stones.

The bearings 284 provide for a smooth, uniform and consistent sharpening motion that improves blade sharpening operation. The bearings 284 provide for a reduced amount of friction that provides for a smooth blade sharpening stroke.

Figure 30:
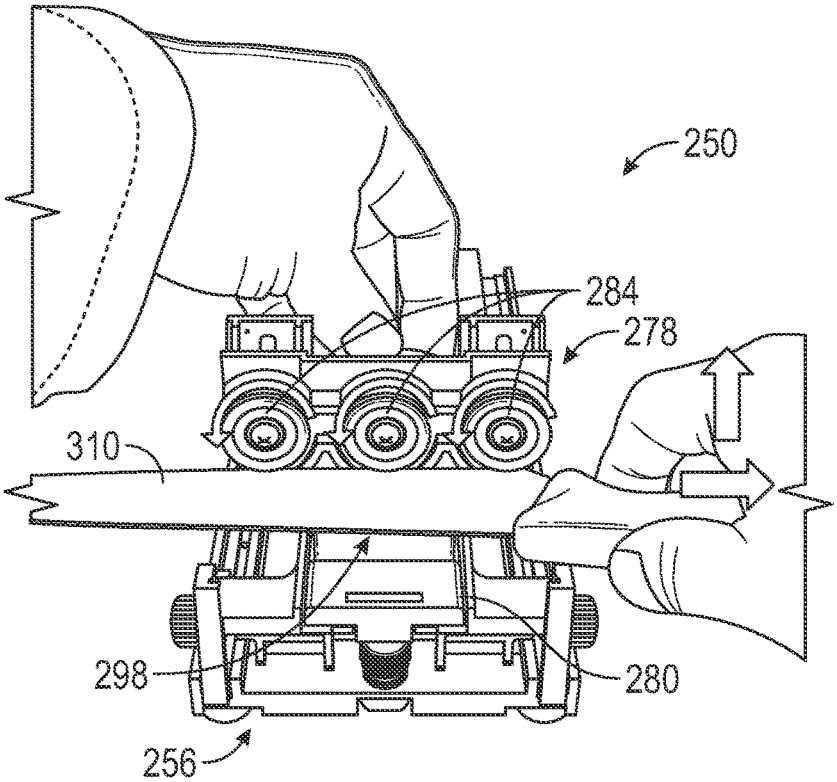
FIG. 30 is a perspective view of a blade sharpening process with the blade in a first position.
Figure 31:
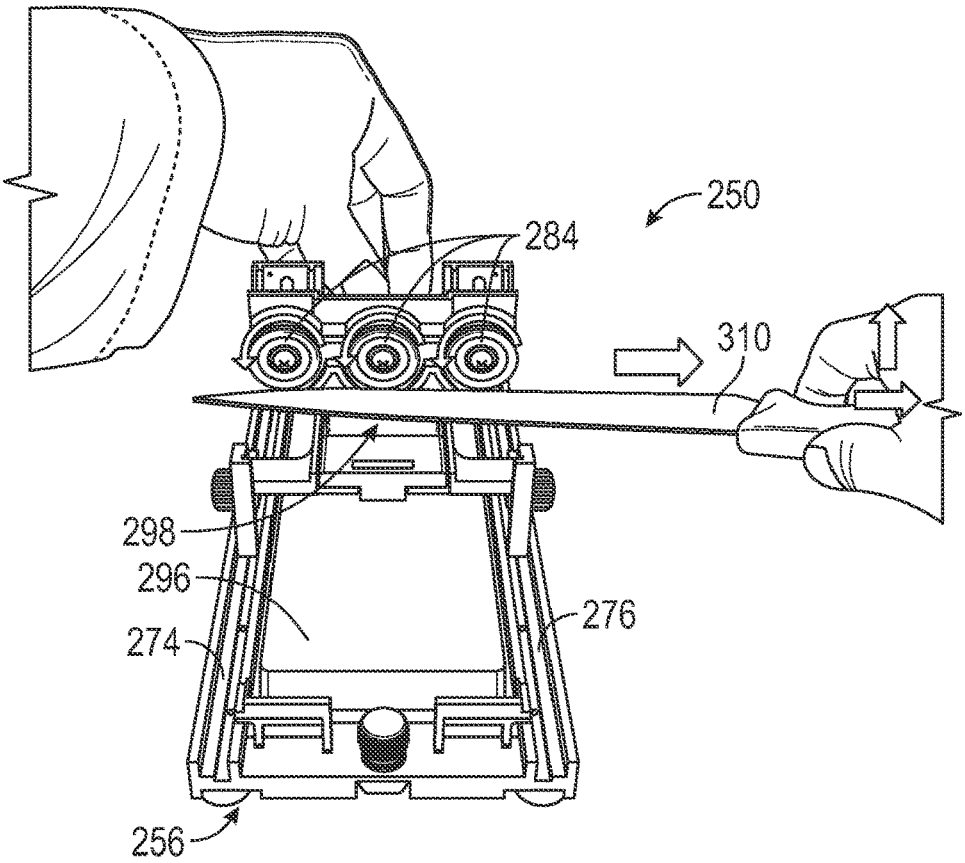
FIG. 31 is a perspective view of the blade sharpening process with the blade in a second position.

Referring to FIGS. 30 and 31, an example sharpening operation is shown using the blade sharpening assembly 250. The bearings 284 are aligned horizontally across the holder portion 278. Because the bearings 284 rotate with the blade as the blade is drawn across the stone, additional pressure can be exerted on the blade. The additional pressure may provide consistent blade sharpening operations for several drawing strokes.

As is shown, once the bearings 284 and the angle plate 298 are set for the specific sharpening stone and blade combination, sharpening is commenced by inserting the blade 310 into the gap 308 therebetween (FIGS. 28B and 29B). The blade 310 is inserted such that one part of the blade edge is on one side of the sharpening stone. The shuttle 254 is then moves longitudinally along the sharpening stone 296 as the blade 310 is drawn across the stone along the bald edge. The direction that the blade 310 is drawn is substantially transvers to the longitudinal movement of the shuttle 254. The shuttle 254 may be pushed away from the user or drawn toward the user and still provide consistent sharpening strokes. The process is repeated until the edge of the blade 310 is sharpened as desired.

The adjustable angle plate 298 and bearings 284 provide consistent and uniform sharpening strokes that provide efficient and consistent edge sharpness.

Accordingly, the disclosed example knife sharpening assemblies provide consistent and repeatable angles of sharpening strokes to enable novice and expert users alike to obtain desirable edge sharpness.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A blade sharpening assembly comprising:

at least one tray configured to support a sharpening element with a sharpening surface; and a shuttle movable relative to the sharpening surface for holding a blade edge relative to the sharpening surface, the shuttle having:

a hold portion including at least two rotatable elements configured to hold the blade against the sharpening element, the hold portion includes a movable element adjustably secured to a fixed element, wherein the at least two rotatable elements are mounted to the movable element; and a guide portion including a surface defining an angle of engagement between a blade edge and the sharpening surface, wherein the guide portion includes an angle plate that is moveable to adjust the angle of engagement between the blade edge and the sharpening surface, the angle plate is supported on the shuttle by at least one fastener securable within a slot, the at least one fastener is moveable within the slot for adjusting the angle of the angle plate, the at least two rotatable elements are mounted to the movable element, and the movable element of the hold portion is movable to adjust a gap between a contact point defined by the at least two rotatable elements and the sharpening surface to receive blades with different thicknesses.

2. The blade sharpening assembly as recited in claim 1, wherein the at least two rotatable elements comprises four rotatable bearings aligned horizontally on the hold portion.

3. The blade sharpening assembly as recited in claim 1, wherein the shuttle further includes a support portion engageable with the tray for aligning the shuttle relative to the sharpening surface.

4. The blade sharpening assembly as recited in claim 1, wherein the guide portion and the hold portion define a transverse axis disposed at a draw angle relative to a longitudinal axis, wherein the draw angle is a direction in which a blade is pulled through the guide portion and the hold portion.

5. A blade sharpening assembly comprising:

at least one tray configured to support a sharpening element with a sharpening surface; and a shuttle movable relative to the sharpening surface for holding a blade edge relative to the sharpening surface, the shuttle having:

a hold portion including at least two rotatable elements configured to hold the blade against the sharpening element, wherein the hold portion includes a movable element that is adjustably secured to a fixed element; and a guide portion including a surface defining an angle of engagement between a blade edge and the sharpening surface, wherein that at least two rotatable elements are mounted to the movable element, and the movable element of the hold portion is movable to adjust a gap between a contact point defined by the at least two rotatable elements and the sharpening surface to receive blades with different thicknesses.

6. A blade sharpening assembly comprising:

at least one tray configured to support a sharpening element with a sharpening surface; and a shuttle movable relative to the sharpening surface for holding a blade edge relative to the sharpening surface, the shuttle having:

a hold portion including at least two rotatable elements configured to hold the blade against the sharpening element blade; and a guide portion including a surface defining an angle of engagement between a blade edge and the sharpening surface, wherein the shuttle further includes a support portion engageable with the tray for aligning the shuttle relative to the sharpening surface and the tray includes first and second movable end walls configured for adjusting a distance therebetween for accommodating sharpening elements of differing lengths.

7. The blade sharpening assembly as recited in claim 6, wherein each of the first and second moveable end walls includes at least two steps for supporting a sharpening element at a different heights within the tray.

8. The blade sharpening assembly as recited in claim 7, wherein the at least two steps comprise three steps for supporting a sharpening element.

9. The blade sharpening assembly as recited in claim 7, wherein the tray includes first and second tracks that receive the support portion of the shuttle for aligning and guiding movement of the shuttle relative to the sharpening surface.

10. A blade sharpening assembly comprising:

a tray configured to support a sharpening element with a sharpening surface, the tray including first and second longitudinal tracks; and a shuttle movable within the first and second longitudinal tracks relative to the sharpening surface, the shuttle configured for holding a blade edge relative to the sharpening surface, the shuttle having a support portion receivable within the first and second longitudinal tracks, a hold portion including at least two bearings configured to hold the blade against the sharpening element, and a guide portion including an angle plate defining an angle of engagement between a blade edge and the sharpening surface, wherein the tray includes first and second movable end walls configured for adjusting a distance therebetween for accommodating sharpening elements of differing lengths.

11. The blade sharpening assembly as recited in claim 10, wherein the angle plate is supported on the shuttle by at least one fastener securable within a slot, the at least one fastener moveable within the slot for adjusting the angle of the angle plate.

12. The blade sharpening assembly as recited in claim 10, wherein the hold portion includes a movable element adjustably secured to a fixed element, wherein the at least two bearings are mounted to the movable element.

13. The blade sharpening assembly as recited in claim 10, wherein each of the first and second moveable end walls includes at least two steps for supporting a sharpening element at a different heights within the tray.

14. A blade sharpening assembly comprising:

a tray configured to support a sharpening element with a sharpening surface, the tray including first and second longitudinal tracks; and a shuttle movable within the first and second longitudinal tracks relative to the sharpening surface, the shuttle configured for holding a blade edge relative to the sharpening surface, the shuttle having a support portion receivable within the first and second longitudinal tracks, a hold portion including at least two bearings configured to hold the blade against the sharpening element, and a guide portion including an angle plate defining an angle of engagement between a blade edge and the sharpening surface, wherein the movable element of the hold portion is movable to adjust a gap between a contact point defined by the at least two bearings and the sharpening surface to receive blades with different thicknesses.

* * * * *